US010164394B2

(12) United States Patent
Guetig et al.

(10) Patent No.: US 10,164,394 B2
(45) **Date of Patent: *Dec. 25, 2018**

(54) DIRECT-ATTACH CONNECTOR

(71) Applicant: Samtec, Inc., New Albany, IN (US)

(72) Inventors: Keith R. Guetig, New Albany, IN (US); Brian R. Vicich, New Albany, IN (US); Andrew R. Collingwood, New Albany, IN (US); Travis S. Ellis, New Albany, IN (US)

(73) Assignee: SAMTEC, INC., New Albany, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/809,169

(22) Filed: Nov. 10, 2017

(65) Prior Publication Data

US 2018/0097326 A1 Apr. 5, 2018

Related U.S. Application Data

(63) Continuation of application No. 15/610,881, filed on Jun. 1, 2017, which is a continuation of application No. 14/551,590, filed on Nov. 24, 2014, now Pat. No. 9,705,273.

(60) Provisional application No. 61/909,223, filed on Nov. 26, 2013.

(51) Int. Cl.

| | |
|---|---|
| ***H01R 12/59*** | (2011.01) |
| ***H01R 43/16*** | (2006.01) |
| *H01R 9/03* | (2006.01) |

(52) U.S. Cl.

CPC ..... *H01R 43/16* (2013.01); *H01R 12/592* (2013.01); *H01R 9/032* (2013.01); *H01R 12/594* (2013.01); *Y10T 29/49174* (2015.01)

(58) Field of Classification Search

CPC .... H01R 12/592; H01R 12/79; H01R 9/0509; H01R 9/009; H01R 24/38; H01R 24/54

USPC ..... 439/495, 580, 885, 497

See application file for complete search history.

(56) References Cited

U.S. PATENT DOCUMENTS

| | | | | |
|---|---|---|---|---|
| 3,910,665 | A | 10/1975 | Stull | |
| 4,385,341 | A | 5/1983 | Main | |
| 4,420,794 | A | 12/1983 | Anderson | |
| 4,790,775 | A * | 12/1988 | David | H01R 9/05 439/579 |
| 4,820,175 | A * | 4/1989 | Hasegawa | H01R 12/775 439/106 |
| 4,973,264 | A * | 11/1990 | Kamono | H01R 12/777 29/879 |
| 5,009,614 | A * | 4/1991 | Fogg | H01R 13/6585 439/497 |

(Continued)

OTHER PUBLICATIONS

Official Communication issued in Chinese Patent Application No. 201480058344.6, dated May 2, 2017.

(Continued)

*Primary Examiner* — Tulsidas C Patel
*Assistant Examiner* — Peter G Leigh
(74) *Attorney, Agent, or Firm* — Keating & Bennett, LLP

(57) ABSTRACT

A contact ribbon configured to connect a cable to a substrate includes a plurality of signal contacts, a ground plane, and at least one ground contact extending from the ground plane. The plurality of signal contacts are connected by a support member, and the support member is removable after the plurality of signal contacts are connected to the cable.

21 Claims, 27 Drawing Sheets

(56) References Cited

U.S. PATENT DOCUMENTS 5,030,138 A * 7/1991 Capp ..... H01R 13/514 439/497
5,032,703 A * 7/1991 Henschen ..... B23K 3/0475 219/553
5,060,372 A * 10/1991 Capp ..... H01R 9/0512 29/883
5,163,849 A * 11/1992 Fogg ..... H01R 13/436 439/497
5,267,874 A * 12/1993 Koegel ..... H01R 13/6592 439/497
5,344,338 A * 9/1994 Colleran ..... H01R 12/772 174/135
5,462,451 A 10/1995 Yeh
5,516,294 A * 5/1996 Andrews ..... H01R 24/50 439/63
5,598,627 A 2/1997 Saka et al.
5,735,695 A * 4/1998 Heinrich ..... H01R 9/0515 439/581
5,902,147 A * 5/1999 Jochen ..... H01R 12/675 439/405
6,113,418 A * 9/2000 Kjeldahl ..... H01R 24/64 439/405
6,196,886 B1 * 3/2001 Sato ..... H01R 43/20 439/885
6,280,260 B1 * 8/2001 Bertsch ..... H01R 13/41 439/733.1
6,380,485 B1 * 4/2002 Beaman ..... H01R 9/035 174/88 R
6,653,569 B1 * 11/2003 Sung ..... H01R 12/675 174/117 F
6,951,477 B2 * 10/2005 Tondreault ..... H01R 4/242 439/497
7,214,097 B1 * 5/2007 Hsu ..... H01R 13/6593 439/607.47
7,959,478 B2 * 6/2011 Chiu ..... H01R 13/65802 439/885
8,007,294 B2 8/2011 Tanaka
8,292,655 B1 * 10/2012 Ling ..... H01R 9/038 439/497
8,466,365 B2 * 6/2013 Gundel ..... H01B 7/0838 174/110 R
8,575,491 B2 * 11/2013 Gundel ..... H01B 7/0861 174/117 F
8,845,364 B2 * 9/2014 Wanha ..... H01R 13/516 439/607.07
2003/0045162 A1 3/2003 Recktenwald et al.
2004/0127078 A1 * 7/2004 Tondreault ..... H01R 4/242 439/98
2005/0176305 A1 * 8/2005 Wu ..... H01R 13/405 439/660
2009/0027867 A1 1/2009 Yamamoto et al.
2009/0215309 A1 * 8/2009 Mongold ..... H01R 12/592 439/495
2009/0305551 A1 * 12/2009 Kameda ..... H01R 9/034 439/497
2011/0294340 A1 * 12/2011 Kojima ..... H01R 12/598 439/497
2012/0252266 A1 * 10/2012 Ling ..... H01R 9/038 439/581
2013/0059471 A1 * 3/2013 Mongold ..... H01R 12/721 439/607.14
2013/0237104 A1 * 9/2013 Fu ..... H01R 43/16 439/885
2015/0118913 A1 * 4/2015 Knowlden ..... H01R 9/16 439/660

OTHER PUBLICATIONS

Guetig et al., "Direct-Attach Connector", U.S. Appl. No. 15/610,881, filed Jun. 1, 2017.

* cited by examiner

FIG. 12A
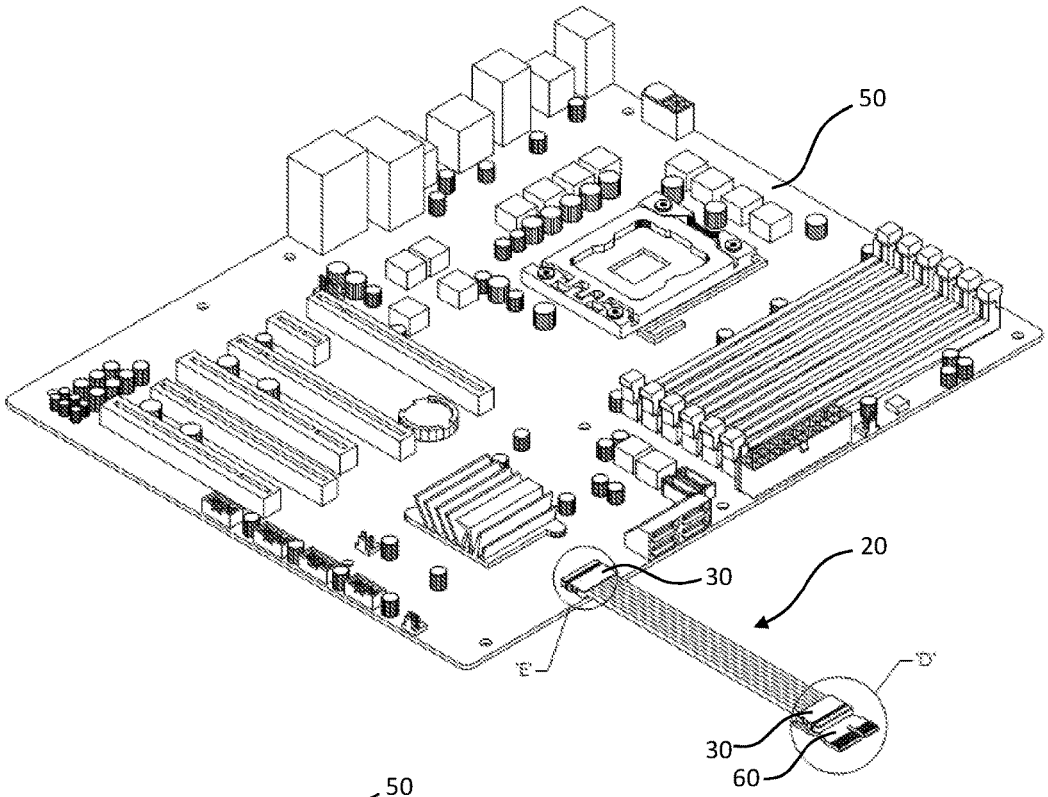
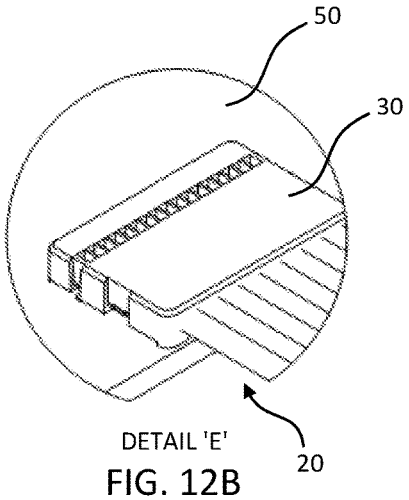
DETAIL 'E'
FIG. 12B
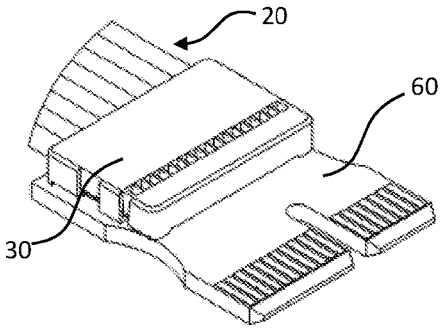
DETAIL 'D'
FIG. 12C FIG. 13A
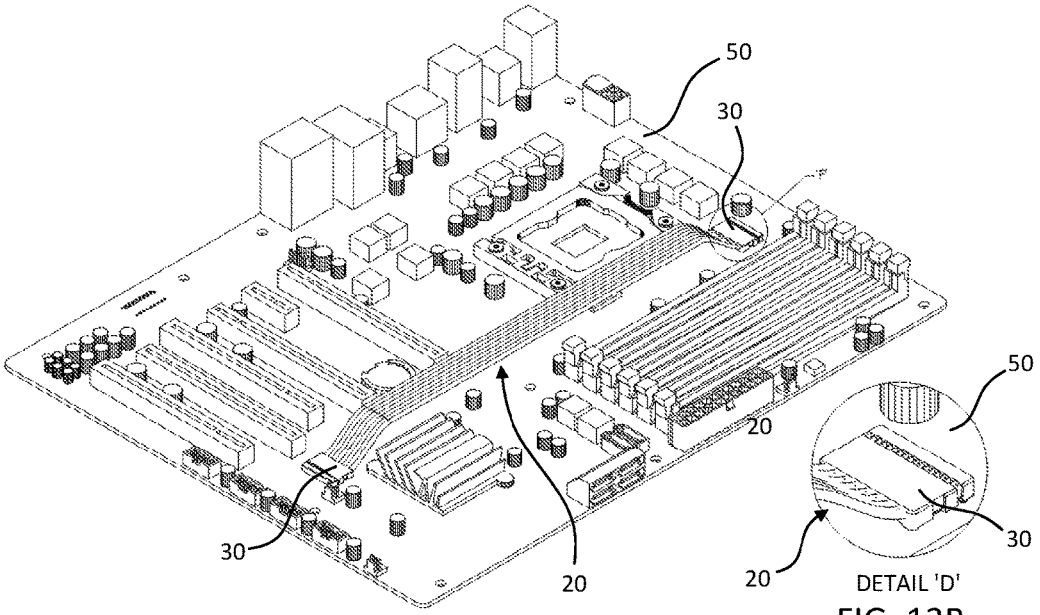
FIG. 13B
FIG. 14A
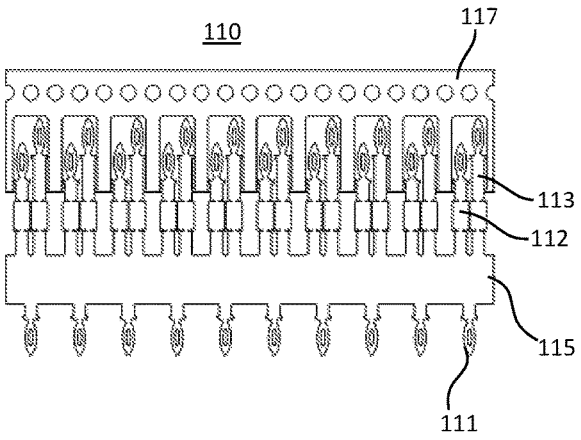
FIG. 14B
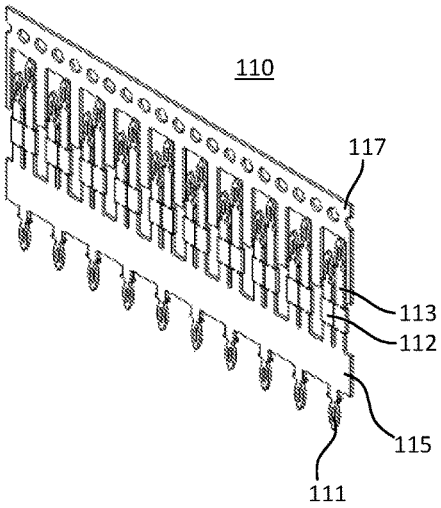

FIG. 22A
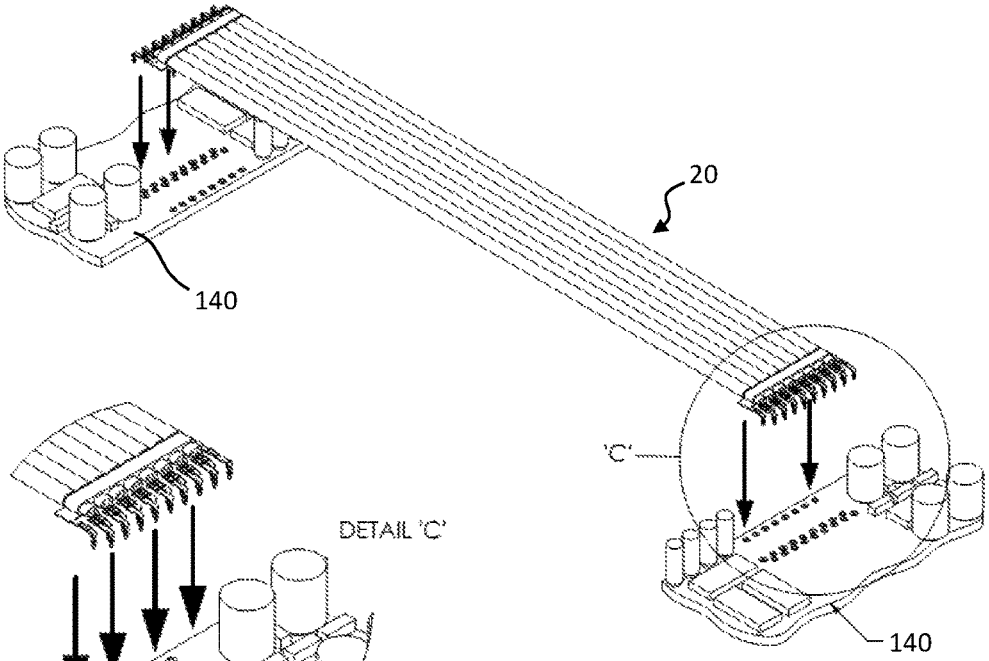
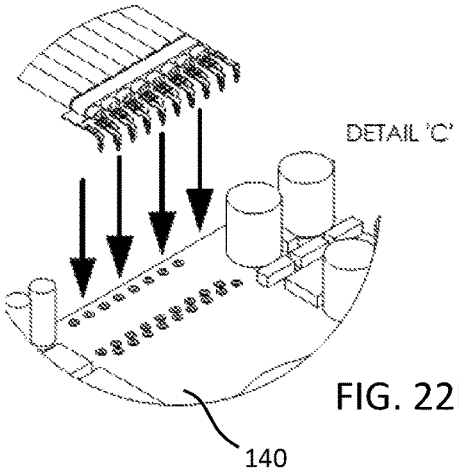
FIG. 22B

FIG. 26A
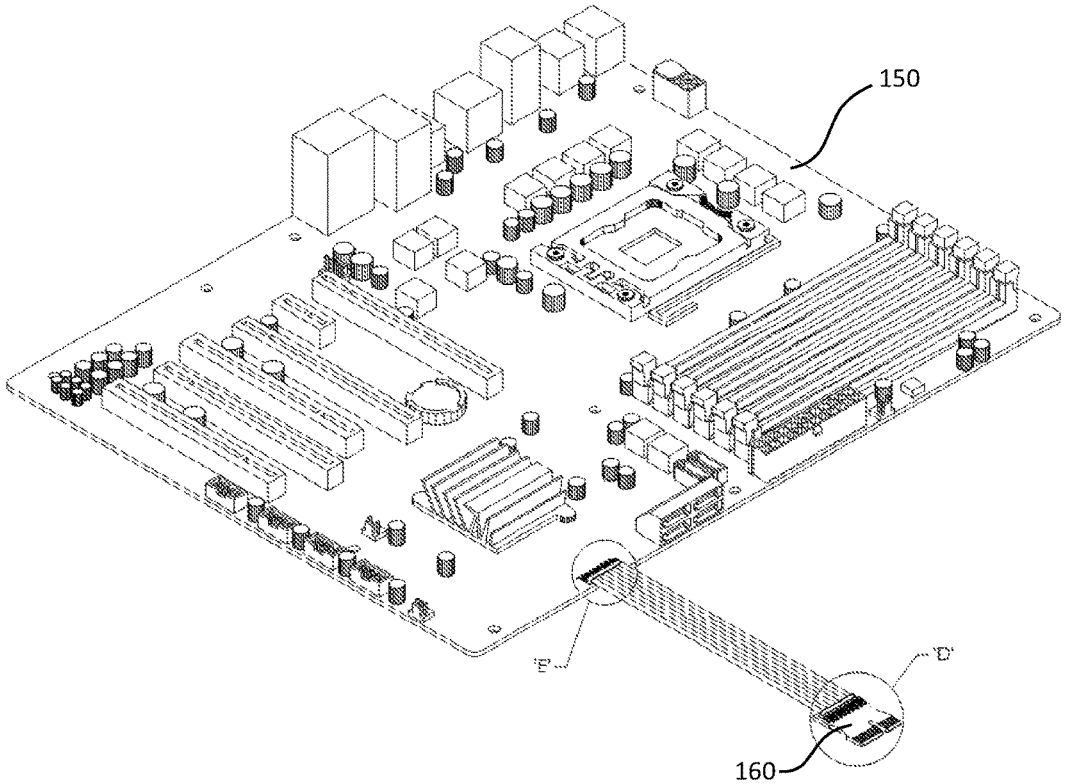
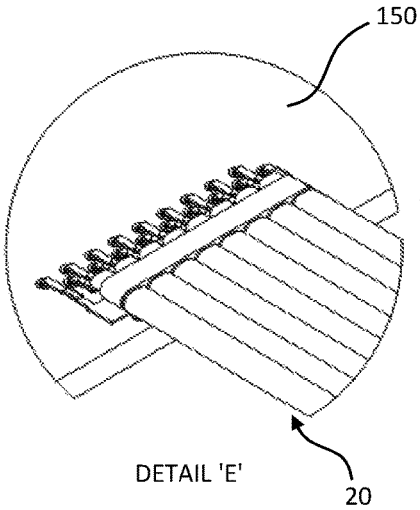
FIG. 26B
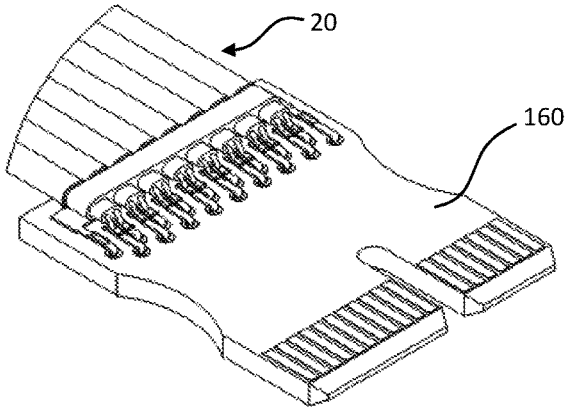
FIG. 26C

FIG. 27A
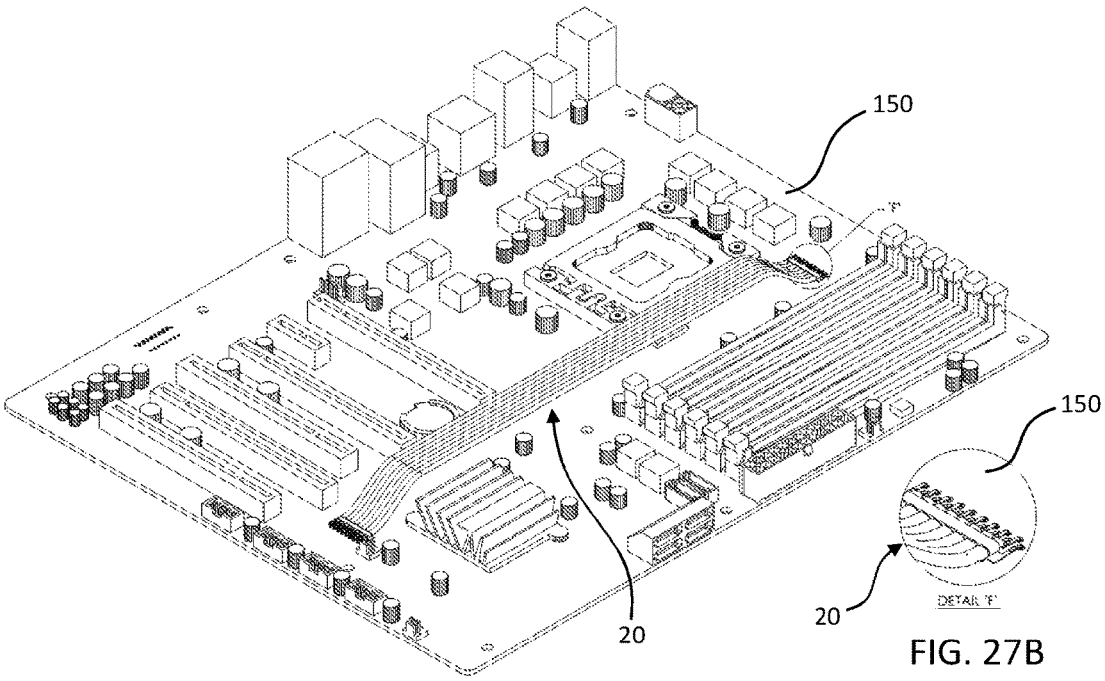
FIG. 27B
FIG. 28
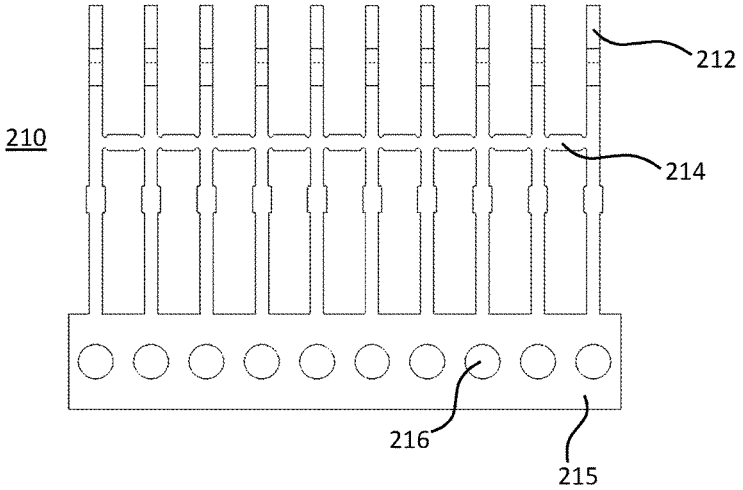

DIRECT-ATTACH CONNECTOR

BACKGROUND OF THE INVENTION

1. Field of the Invention

The present invention relates to connectors for high-speed signal transmission. More specifically, the present invention relates to connectors in which wires are directly connected to contacts of the connectors.

2. Description of the Related Art

High-speed cable routing has been used to transmit signals between substrates, such as printed circuit boards, of electronic devices. Conventional high-speed cable routing often requires routing in very tight and/or low-profile spaces. However, as data rates increase (i.e., the frequency of the high-speed signal increases), the cost of high-performance high-speed transmission systems increases as well. High-speed signals transmitted from between substrates generally follow a path of:

1) a trace of the transmitting substrate;
2) a first connector mounted to the transmitting substrate;
3) a substrate of a second connector that is inserted into the first connector;
4) a high-speed cable connected to the second-connector substrate at a transmitting end of the high-speed cable;
5) a substrate of a third connector connected the high-speed cable at a receiving end of the high-speed cable;
6) a fourth connector, mounted to the receiving substrate, that receives the third-connector substrate; and
7) a trace of the receiving substrate.

Conventional high-speed cable assemblies typically include two connectors (i.e., the second and third connectors listed above) that are connected by high-speed cables. Accordingly, conventional high-speed cable routing also requires an additional two connectors (i.e., the first and fourth connectors listed above) to connect the high-speed cables to transmitting and receiving substrates.

The signal quality is affected every time the transmitted signal transfers from each of the listed items above. That is, the signal quality is degraded when the signal is transmitted between 1) the trace of the transmitting substrate and 2) the first connector mounted to the transmitting substrate, between 2) the first connector mounted to the transmitting substrate and 3) the second-connector substrate that is inserted into the first connector, etc. The signal quality can even be affected within each of the items above. For example, a signal transmitted on the trace of the transmitting or receiving substrate can suffer significant insertion loss.

High-speed cable assemblies are relatively expensive, due in part to the cost of high-speed cable and the two connectors that include substrates (i.e., the second and third connectors listed above). Each connector of the high-speed cable assembly also requires processing time. Thus, the full cost of a high-speed cable assembly cable includes the cable, the high-speed-cable-assembly connectors on each end of the cable, the processing time required for each of these connectors, and the area required on a substrate for each connector.

To reduce the overall size of the high-speed cable assembly, smaller connectors and cables have been attempted. However, using smaller connectors and cables can both increase the cost and reduce the performance of high-speed cable assemblies. Eliminating the high-speed cable assembly has been attempted by transmitting the signal only on substrates. However, signals transmitted on a substrate generally have higher insertion losses compared to many cables, including, for example, micro coaxial (coax) and twinaxial (twinax) cables. Thus, eliminating the high-speed cable assembly can result in reduced signal integrity and degraded performance.

Exotic materials and RF/Microwave connectors have been used to improve the performance of high-speed cable assemblies. However, such materials and connectors increase both the cost and the size of a high-speed cable assembly. Low-cost conductors, dielectrics, and connectors have been used to reduce the overall cost of systems that rely on high-speed cable routing. However, low-cost conductors, dielectrics, and connectors decrease the performance of high-speed cable assemblies and can also increase their size.

SUMMARY OF THE INVENTION

To overcome the problems described above, preferred embodiments of the present invention provide a method of manufacturing a high-speed cable assembly and a high-speed cable assembly that is reduced in size, cheaper, and has improved performance.

A contact ribbon according to a preferred embodiment of the present invention is configured to connect a cable to a substrate and includes a plurality of signal contacts, a ground plane, and at least one ground contact extending from the ground plane. The plurality of signal contacts are connected by a support member, and the support member is removable after the plurality of signal contacts are connected to the cable.

Preferably, the plurality of signal contacts are initially connected to both the ground plane and the support member, and the plurality of signal contacts are disconnected from the ground plane before the signal contacts are connected to the cable. The contact ribbon is preferably included in a housing, and the support member is preferably removed from the contact ribbon after the contact ribbon is included in the housing. The support member is preferably removed after the contact ribbon is connected to the substrate.

Preferably, the plurality of signal contacts are arranged in at least a first row and a second row, and the first row and the second row are offset from each other.

The cable is preferably a twinaxial cable. A shield of the cable is preferably connected to the ground plane.

A method of manufacturing a high-speed cable assembly according to another preferred embodiment of the present invention includes providing a contact ribbon with a plurality of signal contacts, a ground plane, and a support member such that the plurality of signal contacts are connected by the support member; connecting at least a first conductor at a first end of a cable to one of the plurality of signal contacts; connecting at least a second conductor at the first end of the cable to the ground plane; and removing the support member.

Preferably, the first conductor is connected to the one of the plurality of signal contacts by crimping or soldering. The second conductor is preferably connected to the ground plane by soldering.

The method of manufacturing a high-speed cable assembly preferably further includes forming a housing for the contact ribbon before the support member is removed. Preferably, the housing includes at least one hole, and the support member is removed by punching or cutting the support member through the at least one hole of the housing.

The method of manufacturing a high-speed cable assembly preferably further includes attaching the high-speed cable assembly to a substrate before the support member is removed. Preferably, the one of the plurality of signal contacts is connected to a corresponding hole in the substrate by a press-fit connection or soldering or is connected to a corresponding pad on a surface of the substrate.

The method of manufacturing a high-speed cable assembly preferably further includes forming a housing for the contact ribbon before the support member is removed, where the housing includes at least one hole, and inserting a weld tab into the at least one hole of the housing. Preferably, the method further includes attaching the high-speed cable assembly to a substrate by inserting a leg of the weld tab into a corresponding hole in the substrate.

The support member is preferably a carrier attached to the one of the plurality of signal contacts or a tie bar connected between the one of the plurality of signal contacts and another one of the plurality of signal contacts.

The method of manufacturing a high-speed cable assembly preferably further includes providing a second contact ribbon connected to a second end of the cable. Preferably, the plurality of signal contacts of the first contact ribbon are arranged in at least a first row and a second row, the first row and the second row are offset from each other, and a plurality of signal contacts of the second contact ribbon are respectively arranged in rows corresponding to the first row and the second row in an opposing manner such that an overall signal transmission length for each of the conductors of the cable is the same or substantially the same.

Preferred embodiments of the present invention provide a high-speed cable assembly with a low-profile connection to a substrate, preferably having a height dimension of less than about 3 mm in above a surface of the substrate. Because the high-speed cable assembly connects perpendicularly or substantially perpendicularly to the substrate, zero keep-out space on the substrate is needed for slide insertion. Because there is no mating connector required on the substrate, the total amount of required system space, including on the substrate, is relatively small. The high-speed cable assembly also uses a low number of connectors and thus has few transitions in the signal transmission path, thus simplifying the signal transmission path, improving system performance, and reducing costs.

The above and other features, elements, steps, configurations, characteristics and advantages of the present invention will become more apparent from the following detailed description of preferred embodiments of the present invention with reference to the attached drawings.

BRIEF DESCRIPTION OF THE DRAWINGS

FIGS. 8A to 13B show specific applications of the first preferred embodiment of the present invention.

FIGS. 14A and 14B show a contact ribbon with press-fit contacts according to a second preferred embodiment of the present invention.

FIGS. 22A to 27B show specific applications of the second preferred embodiment of the present invention.

FIG. 28 shows a contact ribbon with surface-mount contacts according to a third preferred embodiment of the present invention.

DETAILED DESCRIPTION OF PREFERRED EMBODIMENTS

Preferred embodiments of the present invention will now be described in detail with reference to FIGS. 1 to 35. Note that the following description is in all aspects illustrative and not restrictive and should not be construed to restrict the applications or uses of the present invention in any manner.

Figure 1A:
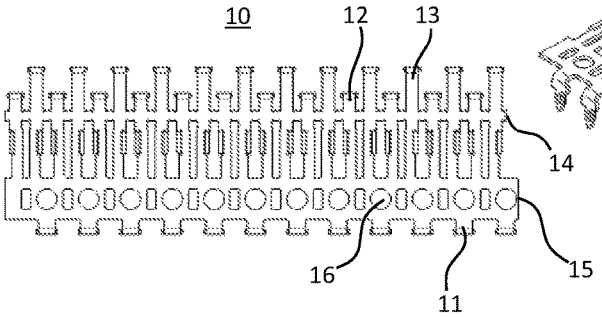
FIGS. 1A and 1B show a contact ribbon with press-fit contacts according to a first preferred embodiment of the present invention.
Figure 1B:
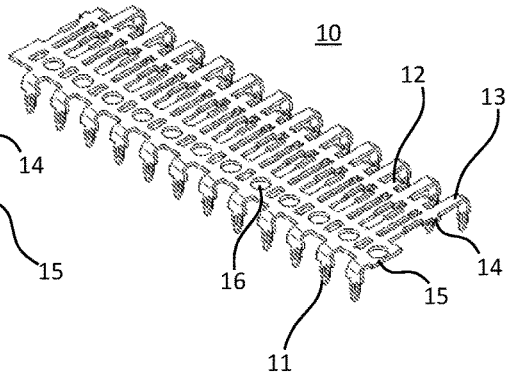

FIGS. 1A to 13B show a high-speed cable assembly according to a first preferred embodiment of the present invention. FIGS. 1A and 1B show a contact ribbon 10 in accordance with the first preferred embodiment of the present invention. The contact ribbon 10 includes one or more ground contacts 11, one or more first contacts 12, and one or more second contacts 13 to provide physical and electrical connections to, for example, a substrate or an electrical connector. The first contacts 12 and the second contacts 13 are preferably staggered or offset with respect to each other in respective rows to reduce the pitch of the high-speed cable assembly. Tie bars 14 connect the first and second contacts 12 and 13 together to provide a rigid structure that structurally supports the first and second contacts 12 and 13 during manufacturing and assembling of the high-speed cable assembly. The ground contacts 11 are connected together by a ground plane 15, which includes pilot holes 16 that provide guidance to stamp the contact ribbon 10. Preferably, the first and second contacts 12 and 13 are also initially connected to the ground plane 15 to provide additional structural support during manufacturing and assembling of the high-speed cable assembly.

As shown in FIGS. 1A and 1B, the ground contacts 11, the first contacts 12, and the second contacts 13 are preferably included in a ribbon, that is, the contact ribbon 10, and arranged such that individual contacts 11, 12, and 13 can be formed by cutting the first and second contacts 12 and 13 from the ground plane 15 and removing the tie bars 14 that connect the first and second contacts 12 and 13. The first and second contacts 12 and 13 preferably include a concave portion that defines a groove to receive, for example, center conductors of coaxial or twinaxial cables, as shown in FIGS. 1B and 4B. Preferably, the staggering of the first and second contacts 12 and 13 on one end of the high-speed cable assembly is the opposite to the staggering of the first and second contacts 12 and 13 on the other end of the high-speed cable assembly such that the overall length of the transmission for each of the signals transmitted by the high-speed cable assembly is the same or substantially the same, within manufacturing tolerances.

Preferably, the legs of ground contacts 11, first contacts 12, and second contacts 13 include a through-hole (e.g., an "eye-of-the-needle" configuration) to provide an oversize fit for press-fit mounting applications. Accordingly, when the legs are press-fit into corresponding mounting holes in a substrate, the legs deform to fit the corresponding mounting holes in the substrate to provide a secure electrical and mechanical connection between the contacts 11, 12, and 13 and the substrate (for example, substrate 40 shown in FIG. 7C).

Figure 2A:
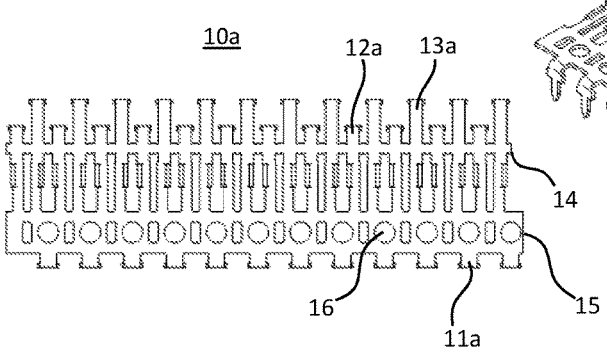
FIGS. 2A and 2B show a contact ribbon with solderable contacts according to the first preferred embodiment of the present invention.
Figure 2B:
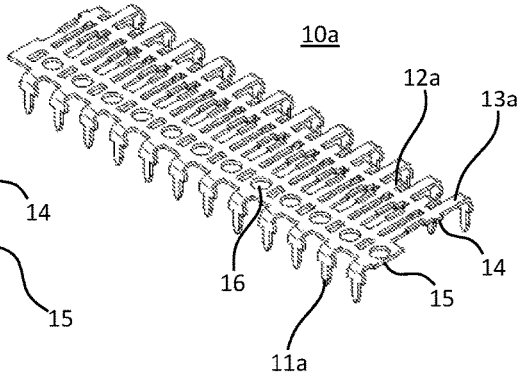

FIGS. 2A and 2B show a contact ribbon 10*a* in accordance with the first preferred embodiment of the present invention. Instead of the press-fit contacts 11, 12, and 13 as shown in FIGS. 1A and 1B, the contact ribbon 10*a* includes ground contacts 11*a*, first contacts 12*a*, and second contacts 13*a* that provide a solderable connection. That is, the contacts 11*a*, 12*a*, and 13*a* have straight legs as compared to the "eye-of-the-needle" legs of the contacts 11, 12, and 13. Accordingly, the contacts 11*a*, 12*a*, and 13*a* may be used, for example, in applications where it is undesirable to engage a connector to a substrate (e.g., printed circuit board) by a press-fit connection or to reduce manufacturing costs while maintaining the other advantages provided by the preferred embodiments of the present invention.

However, the preferred embodiments of the present invention are not limited to the "eye-of-the-needle" and straight-leg configurations described above, and may include a combination of both press-fit and solderable contacts, or any type of suitable contact including, for example, pogo pins, one-piece contact solutions, two-piece contact solutions, compression contacts, pin and socket contacts, single-beam contacts, dual-beam contacts, multi-beam contacts, elastomeric contacts, directly soldered solutions, crimped contacts, welded contacts, etc. Other configurations that may be used with the preferred embodiments of the present invention include, for example, a square post, a kinked pin, an action pin, a Winchester C-Press® compliant pin, or any other suitable configuration. That is, any contact can be used that is connected to the PCB by heat, plastic deformation, or elastic deformation.

Figure 3:
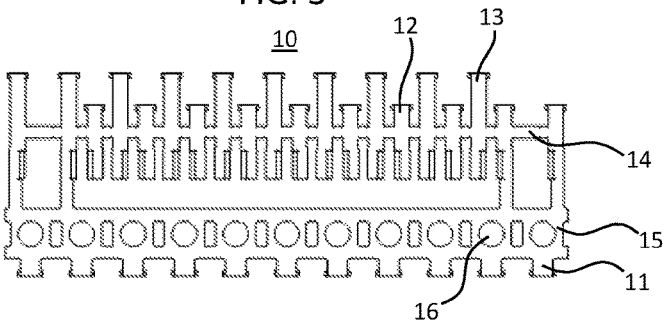
FIGS. 3 to 6B show a process of providing a high-speed cable assembly according to the first preferred embodiment of the present invention.

FIGS. 3-7 show a process of providing the high-speed cable assembly according to the first preferred embodiment of the present invention. As shown in FIG. 3, the first and second contacts 12 and 13 that are to transmit signals are cut or stamped so that they are no longer connected to the ground plane 15. The number of contacts 12 and 13 that are cut preferably corresponds to the number of contacts in the high-speed cable assembly. Preferably, not all of the contacts 12 and 13 are cut such that the rigid structure is maintained for the contact ribbon 10 during assembly and further manufacturing of the high-speed cable assembly. Further, one or more of the first and second contacts 12 and 13 may be left connected to the ground plane 15 to provide additional ground connection(s).

Figure 4A:
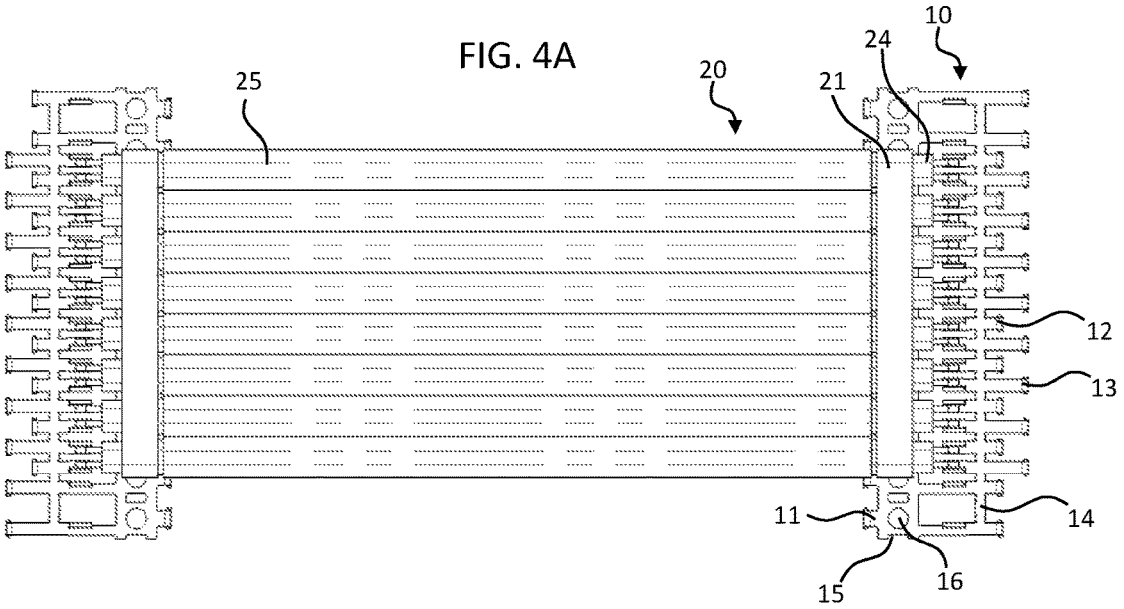
Figure 4B:
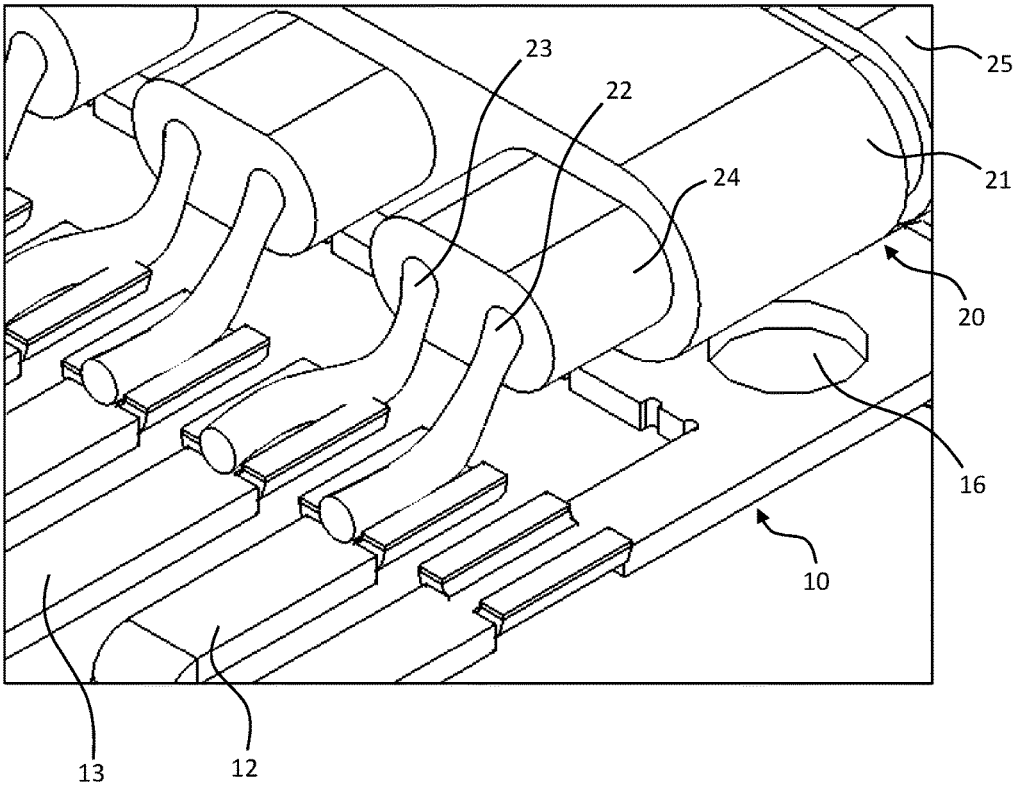

Next, as shown in FIG. 4A, a contact ribbon 10 is connected at both ends of a ribbonized twinaxial cable 20. FIG. 4B is a perspective view of the connections between the contact ribbon 10 and the ribbonized twinaxial cable 20. The ribbonized twinaxial cable 20 includes a shield 21, pairs of first and second center conductors 22 and 23, an insulator 24 for each pair of first and second center conductors 22 and 23, and a jacket 25. The first and second center conductors 22 and 23 are surrounded by the insulator 24, the insulator 24 is surrounded by the shield 21, and the shield 21 is surrounded by the jacket 25.

The shield 21 and the first and second center conductors 22 and 23 are the conductive elements of the ribbonized twinaxial cable 20. The first and second center conductors 22 and 23 are arranged to carry electrical signals, whereas the shield 21 typically provides a ground connection. The shield 21 also provides electrical isolation for the first and second center conductors 22 and 23 and reduces crosstalk between neighboring pairs of the first and second center conductors 22 and 23 and between the conductors of any neighboring cables.

The first and second center conductors 22 and 23 preferably have cylindrical or substantially cylindrical shapes. However, the first and second center conductors 22 and 23 could have rectangular or substantially rectangular shapes or other suitable shapes. The first and second center conductors 22 and 23 and the shield 21 are preferably made of copper. However, the first and second center conductors 22 and 23 and the shield 21 can be made of brass, silver, gold, copper alloy, any highly conductive element that is machinable or manufacturable with a high dimensional tolerance, or any other suitable conductive material. The insulator 24 is preferably formed of a dielectric material with a constant or substantially constant cross-section to provide constant or substantially constant electrical properties for the conductors 22 and 23. The insulator 24 could be made of TEFLON™, FEP (fluorinated ethylene propylene), air-enhanced FEP, TPFE, nylon, combinations thereof, or any other suitable insulating material. The insulator 24 preferably has a round, oval, rectangular, or square cross-sectional shape, but may be formed or defined in any other suitable shape. The jacket 25 protects the other layers of the ribbonized twinaxial cable 20 and prevents the shield 21 from coming into contact with other electrical components to significantly reduce or prevent occurrence of an electrical short. The jacket 25 can be made of the same materials as the insulator 24, FEP, or any suitable insulating material.

As shown in FIGS. 4A and 4B, portions of the first and second center conductors 22 and 23, the insulator 24, and the shield 21 are exposed before the ribbonized twinaxial cable 20 is connected to the contact ribbon 10. The first and second center conductors 22 and 23 are connected to the respective first and second contacts 12 and 13 of the contact ribbon 10. The first and second center conductors 22 and 23 are preferably fusibly connected (for example, by solder) to the first and second contacts 12 and 13 to ensure an uninterrupted electrical connection. Preferably, a hot-bar soldering or other soldering technique is used. However, it is possible to use other suitable methods to connect the first and second center conductors 22 and 23 to the first and second contacts 12 and 13, e.g., crimping, sonically welding, conductive soldering, convective soldering, inductive soldering, radiation soldering, otherwise melting solder to hold the two parts together, pushing the two parts together with enough force to weld the two parts together, or micro-flaming. Preferably, the shield 21 is connected with the ground plane 15 by a hot-bar soldering process, although the shield 21 and the ground plane 15 may be connected by other processes, including the process described above with respect to the first and second center conductors 22 and 23 and the first and second contacts 12 and 13. The pilot holes 16 in the ground plane 15 improve the solder connection between the shield 21 and the ground plane 15 by increasing the area through which solder can flow. The connections between the first and second contacts 12 and 13 to the first and second center conductors 22 and 23 and between the shield 21 and the ground plane 15 can occur either simultaneously or successively.

Although the ribbonized twinaxial cable 20 is shown with a single shield 21 that surrounds all of the pairs of first and second center conductors 22 and 23, the ribbonized twinaxial cable 20 may also be formed with a separate shield for each individual pair of first and second center conductors 22 and 23. If separate shields are used, they are preferably connected to each other and to the ground plane 15 to provide a single, collective ground. However, it is not necessary for separate shields to touch each other after being connected to the ground plane 15. Furthermore, other types of cables, such as coaxial cables, can be used in place of the ribbonized twinaxial cable 20.

Figure 5:
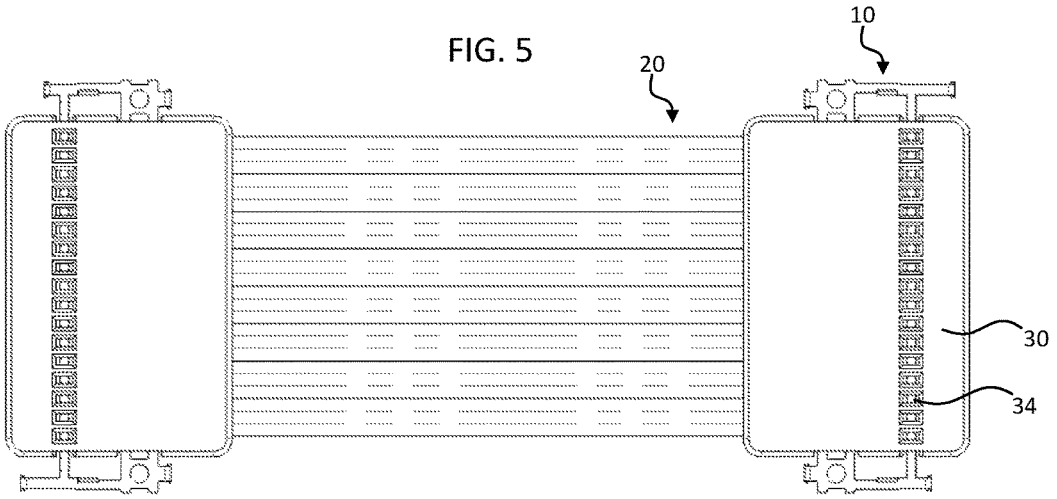
Figure 6A:
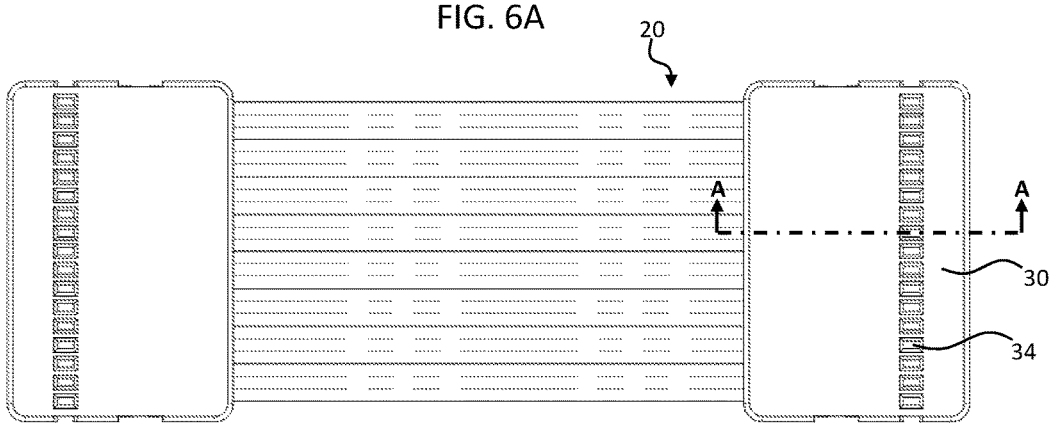
Figure 6B:
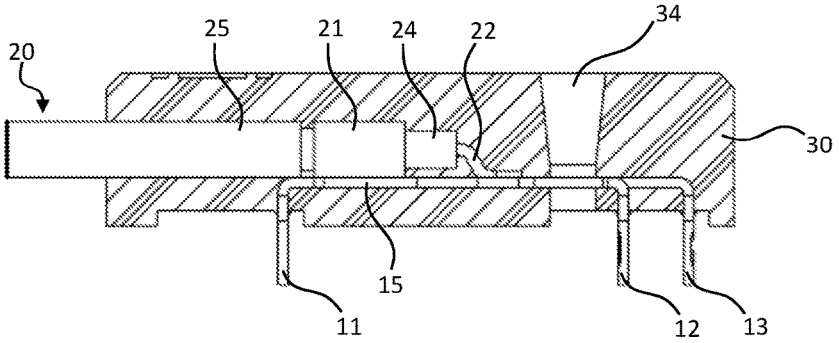

FIG. 5 shows a step of overmolding a connector housing 30 on the contact ribbon 10 to form an electrical connector of the high-speed cable assembly. The connector housing 30 is formed with holes 34 that are arranged over the tie bars 14 of the contact ribbon 10 when the connector housing 30 is molded over the contact ribbon 10. As shown in FIGS. 6A and 6B, after overmolding the connector housing 30 on the contact ribbon 10, the tie bars 14 are removed, preferably by a tool punching into the holes 34 of the connector housing 30. Further, the portions of the contact ribbon 10 that laterally overhang from the connector housing 30 are removed, preferably by cutting or stamping. Accordingly, the first contacts 12 and the second contacts 13 are structurally and electrically disconnected from each other and from the ground plane 15. FIG. 6B is a cross-sectional view taken along line A-A of FIG. 6A and shows the arrangement of the contact ribbon 10 and the twinaxial cable 20 within the connector housing 30. Preferably, because the connector housing 30 is overmolded on the contact ribbon 10, the connector housing 30 is a solid and rigidly supports the connections between the contact ribbon 10 and the twinaxial cable 20. Additionally, the connector housing 30 may include shelf features, retention elements, and/or alignment features that help support the press-in force to retain the contact ribbon 10 within the connector housing 30.

Instead of using overmolding for the connector housing 30, any housing can be used that allows the tie bars 14 between the contacts 12, 13 to be removed. Such housings include, for example, pre-molded, snap-on, sonically welded, screwed-on, and glued housings. However, overmolding is preferred for the connector housing 30 because of its simplicity and because it is easier for a tool to remove the tie bars 14. Preferably, the connector housing 30 is made of plastic, for example, acrylonitrile butadiene styrene (ABS) plastic.

Figure 7A:
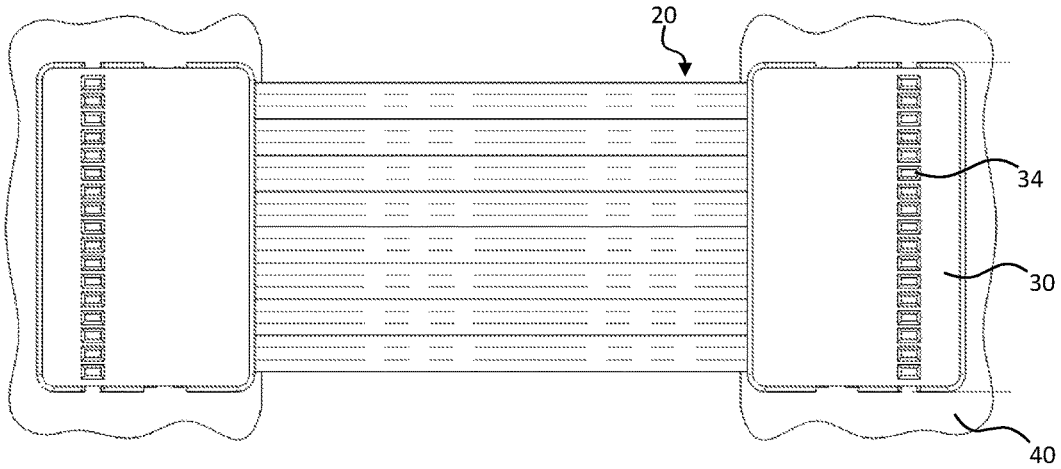
FIGS. 7A and 7B show the high-speed cable assembly shown in FIG. 6A connected to a substrate.
Figure 7B:
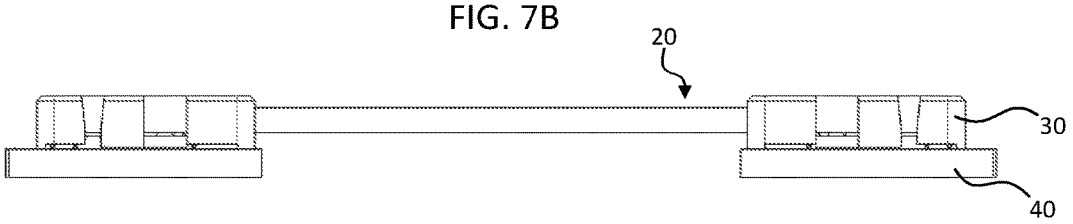
Figure 7C:
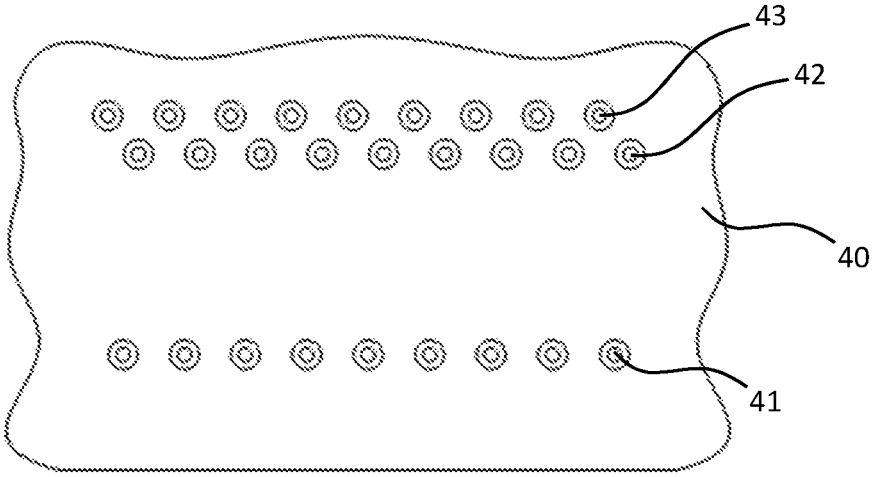
FIG. 7C is a plan view of the substrate shown in FIGS. 7A and 7B.

FIGS. 7A to 7C show the high-speed cable assembly shown in FIG. 6A connected to substrates 40. Preferably, the high-speed cable assembly is connected by press-fitting or soldering to the substrates 40, according to whether the press-fit contact ribbon 10 or the solderable contact ribbon 10*a* was included in the connector housing 30. As shown in FIG. 7C, the substrates 40 include a row of ground mounting holes 41, a row of first mounting holes 42, and a row of second mounting holes 43 that respectively receive the ground contacts 11 or 11*a*, the first contacts 12 or 12*a*, and the second contacts 13 or 13*a*.

If the press-fit contact ribbon 10 is used, the high-speed cable assembly can be press fit to the substrate 40 using a press-fit tool. The press-fit tool is preferably a simple tool, including, for example, a flat block attached to an arbor press, a tool with a cavity that aligns with the housing, a tap hammer, etc. That is, it is not necessary to use an expensive tool to transfer a force directly and individually to the back of each of the contacts 11, 12, and 13. Typically, the high-speed cable assembly is only mated to the substrate 40 once; however, it is possible to unmate the high-speed cable assembly and the substrate 40 and then to re-mate the high-speed cable assembly and the substrate 40, if desired. For example, it is possible to remove the press-fit contacts 11, 12, and 13 or to unsolder the solderable contacts 11*a*, 12*a*, and 13*a*.

Figures 8A, 8B:
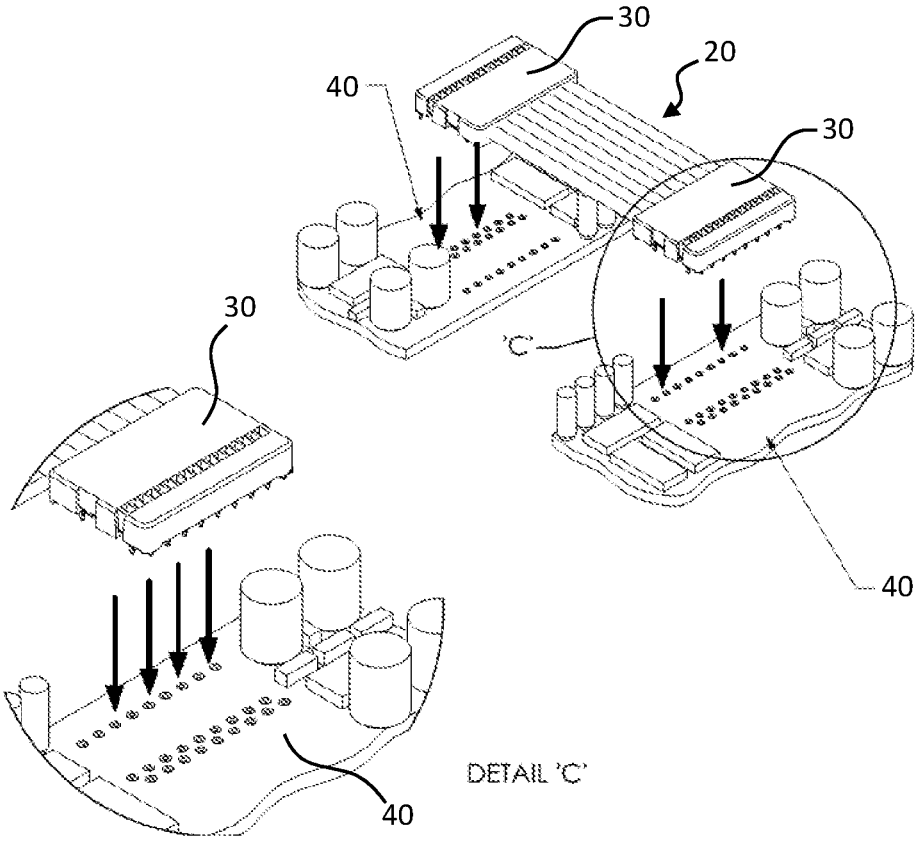

As explained below, the high-speed cable assembly can be connected to the same substrate or to different substrates. FIGS. 8A to 13B show various specific applications for the high-speed cable assembly. FIG. 8A is a perspective view of the connection between the high-speed cable assembly and the substrate 40 shown in FIGS. 7A to 7C, and FIG. 8B is a detail view of the connector housing 30 engaging the substrate 40.

Figure 9A:
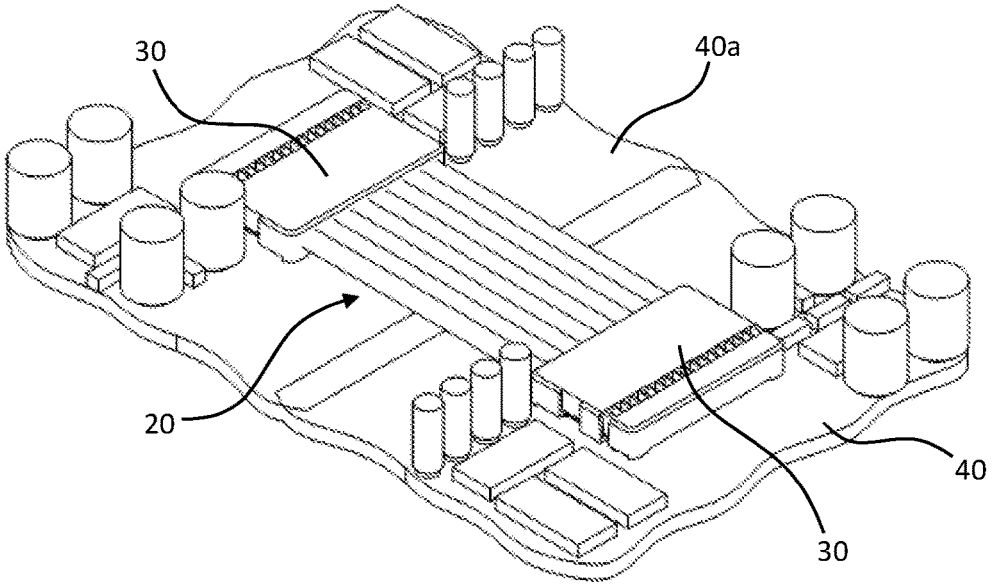
Figure 9B:
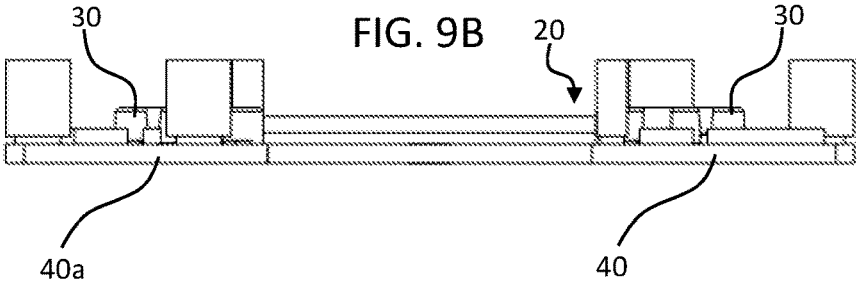
Figure 10A:
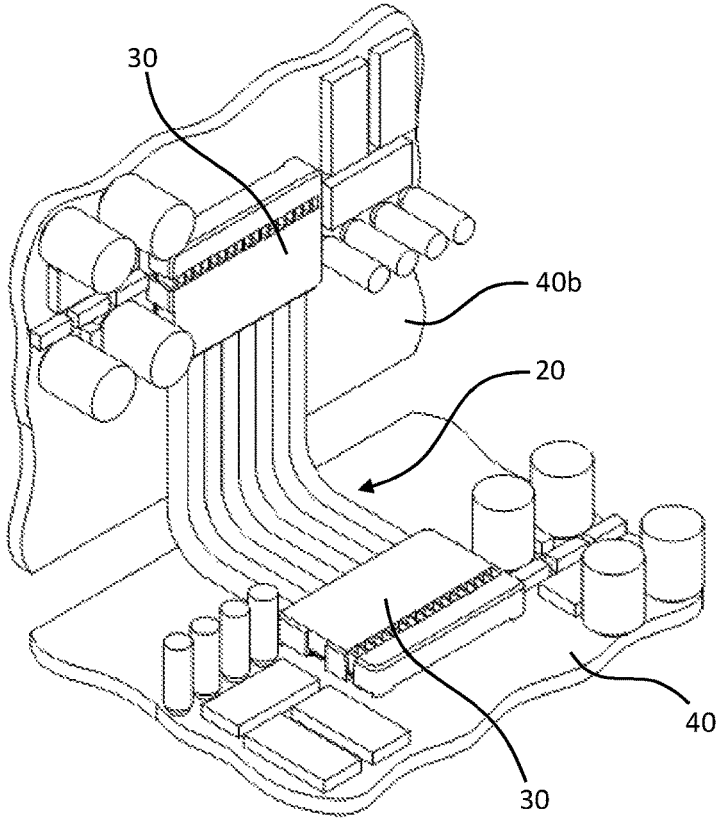
Figure 10B:
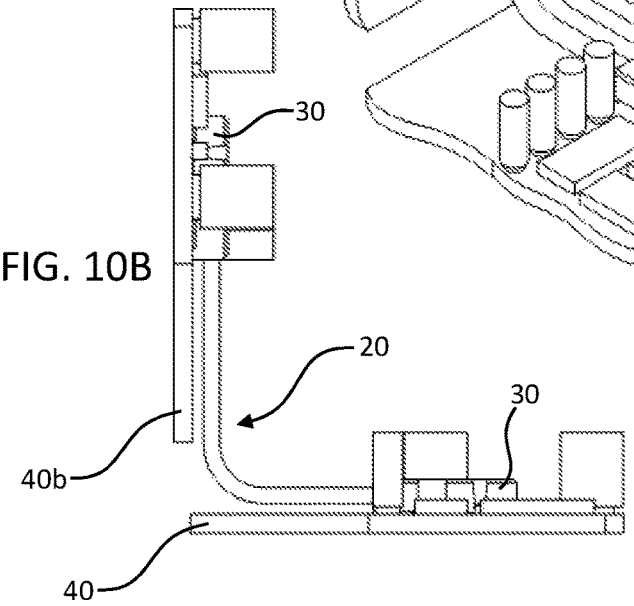
Figure 11A:
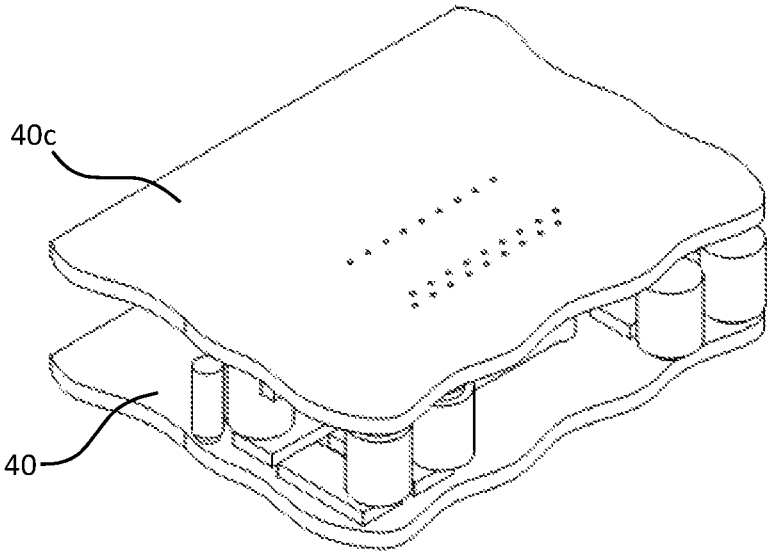
Figure 11B:
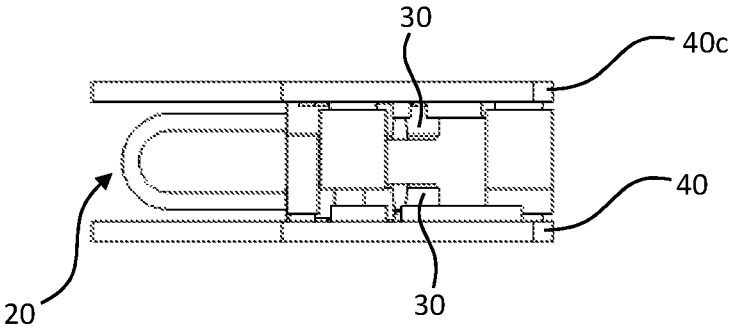

FIGS. 9A and 9B show an edge-to-edge application in which the substrate 40 is connected to a substrate 40*a* that is co-planar or substantially co-planar and aligned along a common edge. FIGS. 10A and 10B show a right-angle application in which the substrate 40 is connected to a substrate 40*b* that is perpendicular or substantially perpendicular. FIGS. 11A and 11B show a board-to-board application in which the substrate 40 is connected to a substrate 40*c* that is parallel or substantially parallel, but not coplanar, for example, when the surfaces of the substrates 40 and 40*c* that are connected by the high-speed cable assembly are facing each other.

FIG. 12A shows a board-to-edge-card application in which one end of the high-speed cable assembly is connected to a relatively large substrate, such as a computer motherboard 50, and the other end of the high-speed cable assembly is connected to a relatively small edge-card 60. FIG. 12B is a detail view of the connection between the high-speed cable assembly and the computer motherboard 50 in the board-to-edge-card application, and FIG. 12C is a detail view of the connection between the high-speed cable assembly and the edge-card 60. FIG. 13A shows a high-speed-flyover application in which both ends of the high-speed cable assembly are connected to the same substrate, such as the computer motherboard 50. FIG. 13B is a detail view of the connection between the high-speed cable assembly and the computer motherboard 50 in the high-speed-flyover application.

FIGS. 14A to 27B show a high-speed cable assembly according to a second preferred embodiment of the present invention. FIGS. 14A and 14B show a contact ribbon 110 in accordance with the second preferred embodiment of the present invention. The contact ribbon 110 includes one or more ground contacts 111, one or more first contacts 112, and one or more second contacts 113 to provide physical and electrical connections to, for example, a substrate or an electrical connector. The first contacts 112 and the second contacts 113 are preferably staggered or offset with respect to each other in respective rows to reduce the pitch of the high-speed cable assembly. A carrier 117 connects the first and second contacts 112 and 113 together to provide a rigid structure that structurally support the first and second contacts 112 and 113 during manufacturing and assembling of the high-speed cable assembly. Preferably, the carrier 117 allows for the contact ribbon 110 to be easily manipulated and positioned, for example, by hand, and the carrier 117 may also include pilot holes that provide guidance to stamp the contact ribbon 110. The ground contacts 111 are connected together by a ground plane 115. Preferably, the first and second contacts 112 and 113 are also initially connected to the ground plane 115 to provide additional structural support during manufacturing and assembling of the high-speed cable assembly.

As shown in FIGS. 14A and 14B, the ground contacts 111, the first contacts 112, and the second contacts 113 are preferably included in a ribbon, that is, the contact ribbon 110, and arranged such that individual contacts 111, 112, and 113 can be formed by cutting the first and second contacts 112 and 113 from the ground plane 15 and removing the carrier 117. The first and second contacts 112 and 113 preferably include a concave portion that defines a groove to receive, for example, center conductors of coaxial or twinaxial cables, as shown in FIGS. 14A, 14B, and 16A to 16C. Preferably, the staggering of the first and second contacts 112 and 113 on one end of the high-speed cable assembly is the opposite to the staggering of the first and second contacts 112 and 113 on the other end of the high-speed cable assembly such that the overall length of the transmission for each of the signals transmitted by the high-speed cable assembly is the same or substantially the same, within manufacturing tolerances.

Preferably, the legs of ground contacts 111, first contacts 112, and second contacts 113 include a through-hole (e.g., an "eye-of-the-needle" configuration) to provide an oversize fit for press-fit mounting applications. Accordingly, when the legs are press-fit into corresponding mounting holes in a substrate, the legs deform to fit the corresponding mounting holes in the substrate to provide a secure electrical and mechanical connection between the contacts 111, 112, and 113 and the substrate (for example, substrate 140 shown in FIG. 21).

Figure 15A:
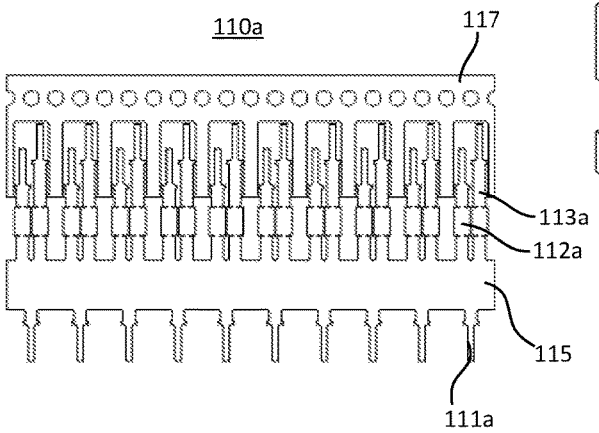
FIGS. 15A and 15B show a contact ribbon with solderable contacts according to the second preferred embodiment of the present invention.
Figure 15B:
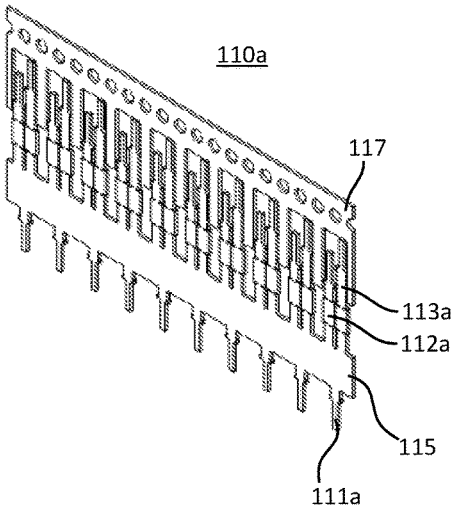

FIGS. 15A and 15B show a contact ribbon 110*a* in accordance with the second preferred embodiment of the present invention. Instead of the press-fit contacts 111, 112, and 113 as shown in FIGS. 14A and 14B, the contact ribbon 110*a* includes ground contacts 111*a*, first contacts 112*a*, and second contacts 113*a* that provide a solderable connection. That is, the contacts 111*a*, 112*a*, and 113*a* preferably include straight legs as compared to the "eye-of-the-needle" legs of the contacts 111, 112, and 113. Accordingly, the contacts 111*a*, 112*a*, and 113*a* may be used, for example, in applications where it is undesirable to engage a connector to a substrate (e.g., printed circuit board) by a press-fit connection or to reduce manufacturing costs while maintaining the other advantages provided by the preferred embodiments of the present invention. However, the preferred embodiments of the present invention are not limited to the "eye-of-the-needle" and straight-leg configurations described above, and may include a combination of both press-fit and solderable contacts, or any type of suitable contact including those described above with respect to the first preferred embodiment of the present invention.

Figure 16A:
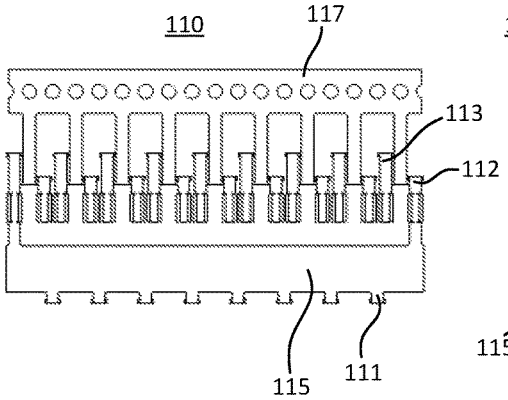
FIGS. 16A to 19 show a process of providing a high-speed cable assembly according to the second preferred embodiment of the present invention.
Figure 16B:
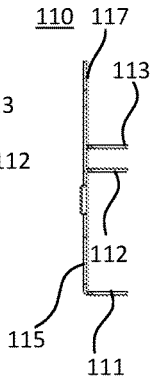
Figure 16C:
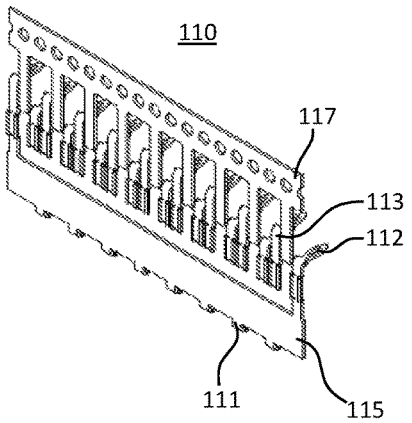

FIGS. 16A to 19 show a process of providing the high-speed cable assembly according to the second preferred embodiment of the present invention. As shown in FIGS. 16A to 16C, the first and second contacts 112 and 113 that are to transmit signals are cut or stamped so that they are no longer connected to the ground plane 115. The number of contacts 112 and 113 that are cut preferably corresponds to the number of contacts in the high-speed cable assembly. Preferably, not all of the contacts 112 and 113 are cut such that the rigid structure is maintained for the contact ribbon 110 during assembly and further manufacturing of the high-speed cable assembly. Further, one or more of the first and second contacts 112 and 113 may remain connected to the ground plane 115 to provide additional ground connection(s). Preferably, the outermost ones of the first and second contacts 112 and 113 at the opposing sides of the contact ribbon 110 are left connected to the ground plane 115 to provide structural support during manufacturing and assembling of the high-speed cable assembly.

Figure 17:
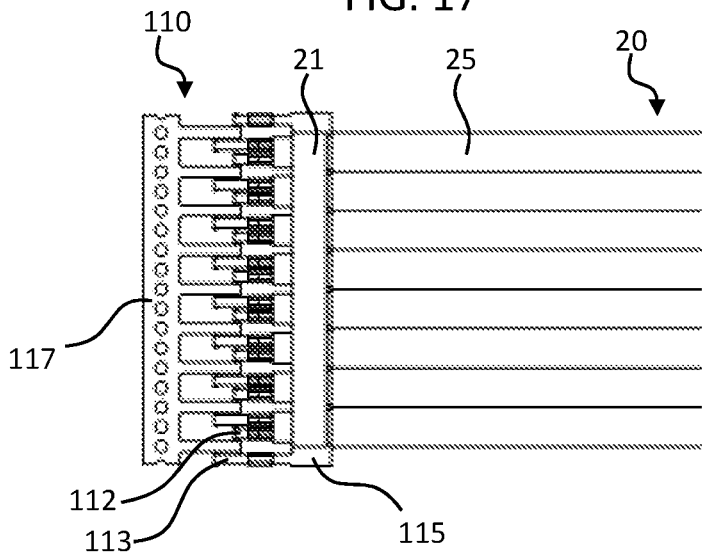
Figure 18:
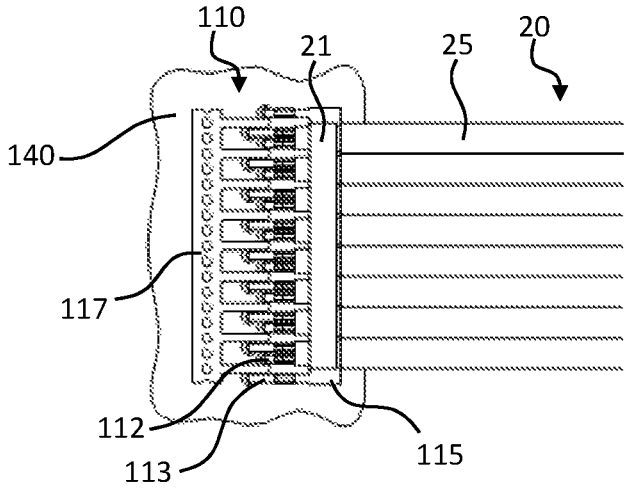

Next, as shown in FIG. 17, the contact ribbon 110 is connected to a ribbonized twinaxial cable 20. Preferably, the contact ribbon 110 is connected to the ribbonized twinaxial cable 20 in the same manner as the contact ribbon 10 of the first preferred embodiment of the present invention. That is, as shown in FIG. 18, the first and second center conductors 22 and 23 of the ribbonized twinaxial connector 20 are connected to the respective first and second contacts 112 and 113 of the contact ribbon 110, and the shield 21 of the ribbonized twinaxial connector 20 is connected with the ground plane 115. The connections between the first and second contacts 112 and 113 to the first and second center conductors 22 and 23 and between the shield 21 and the ground plane 115 can occur either simultaneously or successively. Although not shown, the contact ribbon 110 according to the second preferred embodiment of the present invention may also include pilot holes in the ground plane 115, similar to the pilot holes 16 in the contact ribbon 10 of the first preferred embodiment of the present invention, in order to provide guidance to stamp the contact ribbon 110 and to improve the solder connection between the shield 21 and the ground plane 115 by increasing the area through which solder can flow. Furthermore, other types of cables, such as coaxial cables, can be used in place of the ribbonized twinaxial cable 20.

Figure 21:
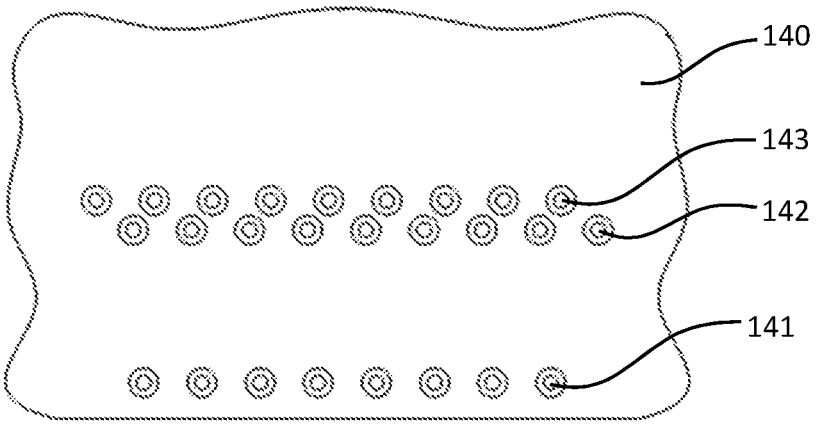
FIG. 21 is top plan view of the substrate shown in FIGS. 18 to 20B.

The contact ribbon 110, with the ribbonized twinaxial cable 20 connected thereto, is then connected to a substrate 140, as shown in FIG. 18. Preferably, the high-speed cable assembly is connected by press-fit or soldering to the substrate 140, according to whether the press-fit contact ribbon 110 or the solderable contact ribbon 110*a* is used. As shown in FIG. 21, which is a top plan view of the substrate 140, the substrate 140 includes a row of ground mounting holes 141, a row of first mounting holes 142, and a row of second mounting holes 143 that respectively receive the ground contacts 111 or 111*a*, the first contacts 112 or 112*a*, and the second contacts 113 or 113*a*. As compared with the corresponding pairs of first and second mounting holes 41 and 42 of the first preferred embodiment of the present invention, the corresponding pairs of first and second mounting holes 141 and 142 of the second preferred embodiment of the present invention have a relatively larger spacing in order to accommodate for the attachment of the carrier 117.

If the press-fit contact ribbon 110 is used, the high-speed cable assembly can be press fit to the substrate 140 using a press-fit tool. The press-fit tool is preferably a simple tool, including, for example, a flat block attached to an arbor press, a tool with a cavity that aligns with the housing, a tap hammer, etc. That is, it is not necessary to use an expensive tool to transfer a force directly and individually to the back of each of the contacts 111, 112, and 113. Typically, the high-speed cable assembly is only mated to the substrate 140 once; however, it is possible to unmate the high-speed cable assembly and the substrate 140 and then to re-mate the high-speed cable assembly and the substrate 140, if desired.

For example, it is possible to remove the press-fit contacts 111, 112, and 113 or to unsolder the solderable contacts 111*a*, 112*a*, and 113*a*.

Figure 19:
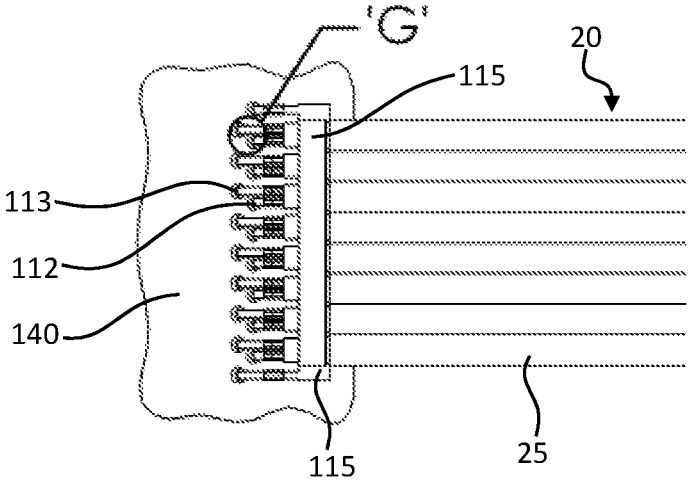
Figure 20A:
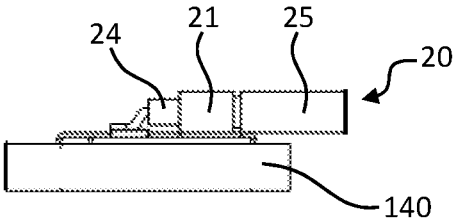
FIGS. 20A and 20B are detail views of the high-speed cable assembly connected to a substrate according to the second preferred embodiment of the present invention.
Figure 20B:
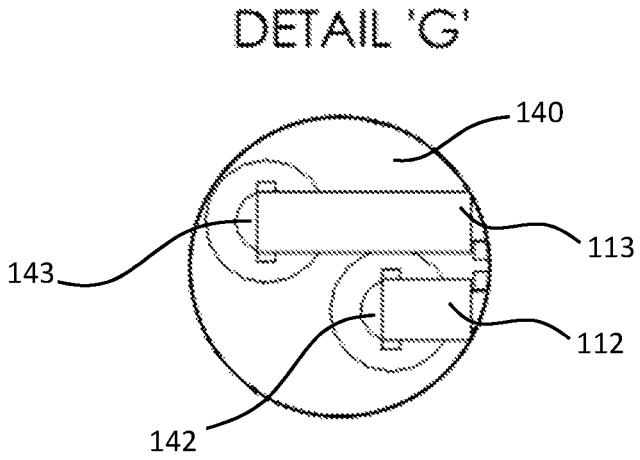

After the contact ribbon 110 or 110*a* is connected to the substrate 140, the carrier 117 is removed as shown in FIG. 19. Preferably, the carrier 117 is scored so that it can be easily removed from the contact ribbon 110 by being twisted away from the contact ribbon 110. FIGS. 20A and 20B are detail views of the high-speed cable assembly connected to substrate 140, which provides a low profile. In particular, because the second preferred embodiment of the present invention does not include a connector housing, a profile even lower than that of the first preferred embodiment of the present invention can be obtained, and is as low as about 1.74 mm, for example.

As explained below, the high-speed cable assembly can be connected to the same substrate or to different substrates. FIGS. 22A to 27B show various specific applications for the high-speed cable assembly. FIG. 22A is a perspective view of the connection between the high-speed cable assembly and the substrate 140 shown in FIGS. 19 to 21, and FIG. 8B is a detail view of the high-speed cable assembly engaging the substrate 140.

Figure 23A:
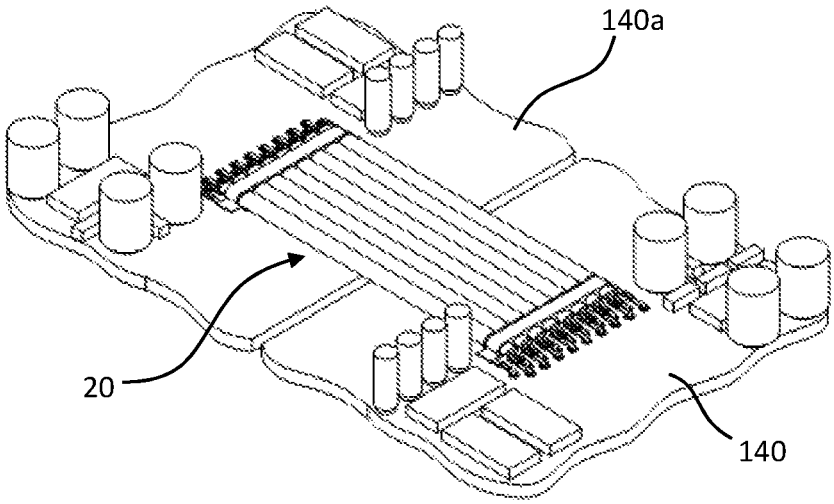
Figure 23B:
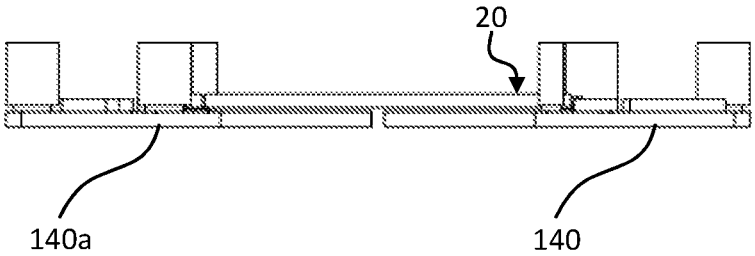
Figure 24A:
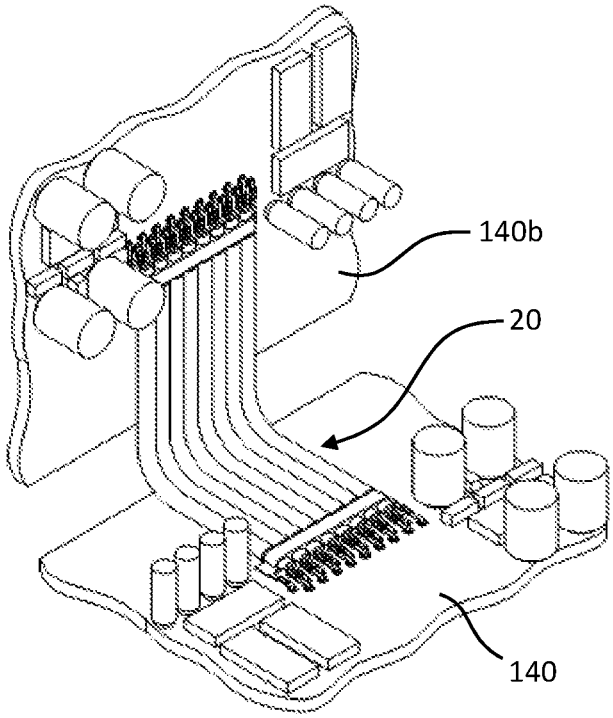
Figure 24B:
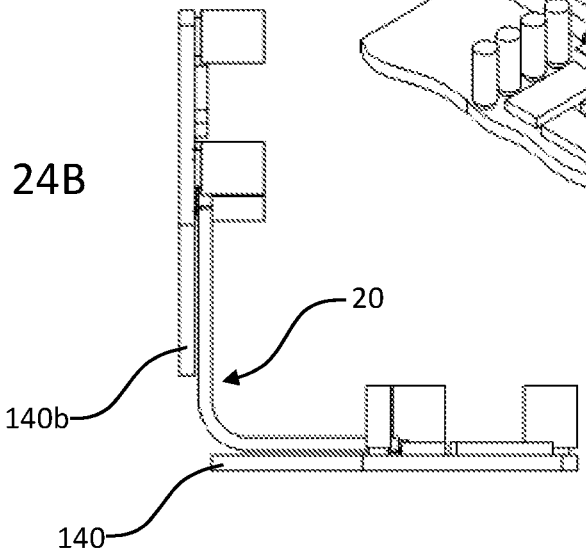
Figure 25A:
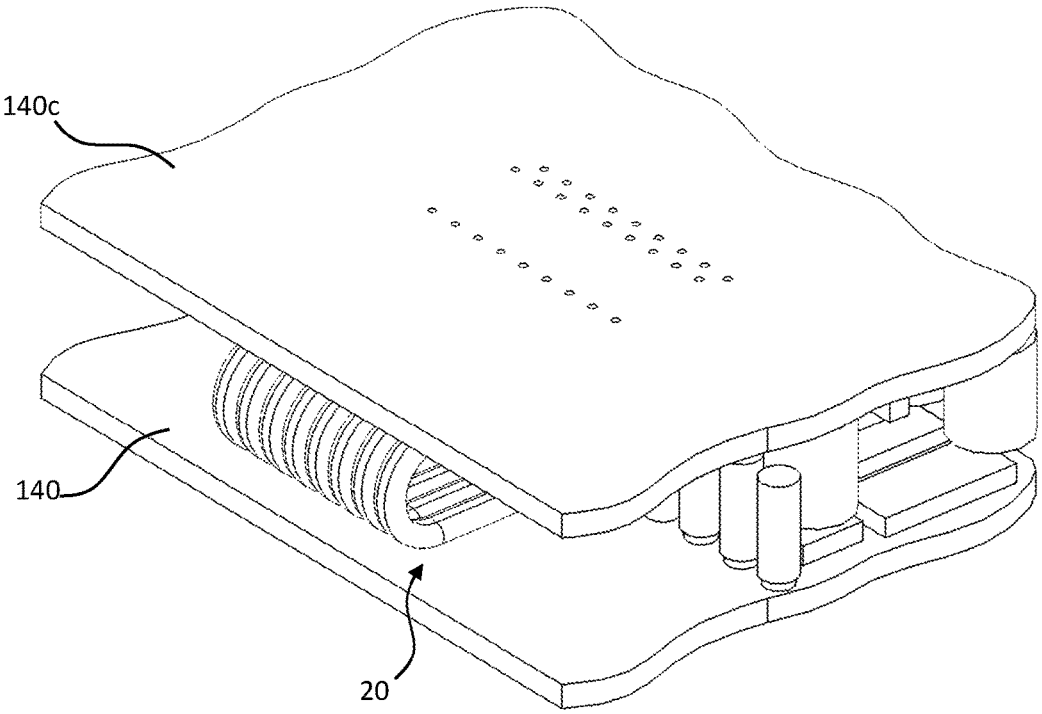
Figure 25B:
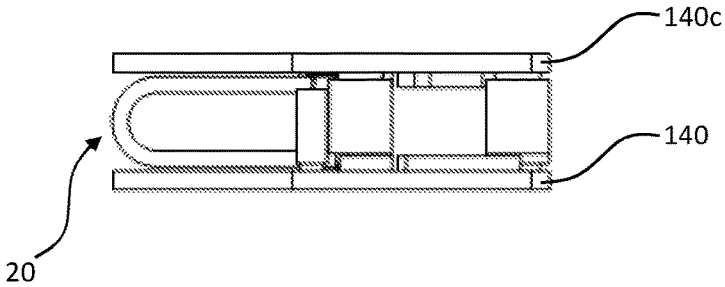

FIGS. 23A and 23B show an edge-to-edge application in which the substrate 140 is connected to a substrate 140*a* that is co-planar or substantially co-planar and aligned along a common edge. FIGS. 24A and 24B show a right-angle application in which the substrate 140 is connected to a substrate 140*b* that is perpendicular or substantially perpendicular. FIGS. 25A and 25B show a board-to-board application in which the substrate 140 is connected to a substrate 140*c* that is parallel or substantially parallel, but not coplanar, for example, when the surfaces of the substrates 140 and 140*c* that are connected by the high-speed cable assembly are facing each other.

FIG. 26A shows a board-to-edge-card application in which one end of the high-speed cable assembly is connected to a relatively large substrate, such as a computer motherboard 150, and the other end of the high-speed cable assembly is connected to a relatively small edge-card 160. FIG. 26B is a detail view of the connection between the high-speed cable assembly and the computer motherboard 150 in the board-to-edge-card application, and FIG. 26C is a detail view of the connection between the high-speed cable assembly and the edge-card 160. FIG. 27A shows a high-speed-flyover application in which both ends of the high-speed cable assembly are connected to the same substrate, such as the computer motherboard 150. FIG. 27B is a detail view of the connection between the high-speed cable assembly and the computer motherboard 150 in the high-speed-flyover application.

FIGS. 28 to 35 show a high-speed cable assembly according to a third preferred embodiment of the present invention. FIG. 28 shows a contact ribbon 210 according to a third preferred embodiment of the present invention. The contact ribbon 210 includes one or more contacts 212 to provide physical and electrical connections to, for example, a substrate or an electrical connector. The contacts 212 are preferably included in a single row. However, adjacent ones of the contacts 212 may be staggered or offset with respect to each other to reduce the pitch of the high-speed cable assembly. Tie bars 214 connect to the contacts 212 together to provide a rigid structure that structurally supports the contacts 212 during manufacturing and assembling of the high-speed cable assembly. The contact ribbon 210 further includes a ground plane 215, which contains pilot holes 216 that provide guidance to stamp the contact ribbon 210. Preferably, the contacts 212 are also initially connected to the ground plane 215 to provide additional structural support during manufacturing and assembling of the high-speed cable assembly.

As shown in FIG. 28, the contacts 212 are preferably included in a ribbon, that is, the contact ribbon 210, and configured such that individual contacts 212 can be formed by cutting the contacts 212 from the ground plane 215 and removing the tie bars 214 that connect the contacts 212. The contacts 212 may include a concave portion that defines a groove to receive, for example, center conductors of coaxial or twinaxial cables. Preferably, the contacts 212 have offset straight legs that provide a surface-mount connection to pads on a substrate (for example, the pads 241 on the substrate 240 shown in FIG. 34C).

Figure 29A:
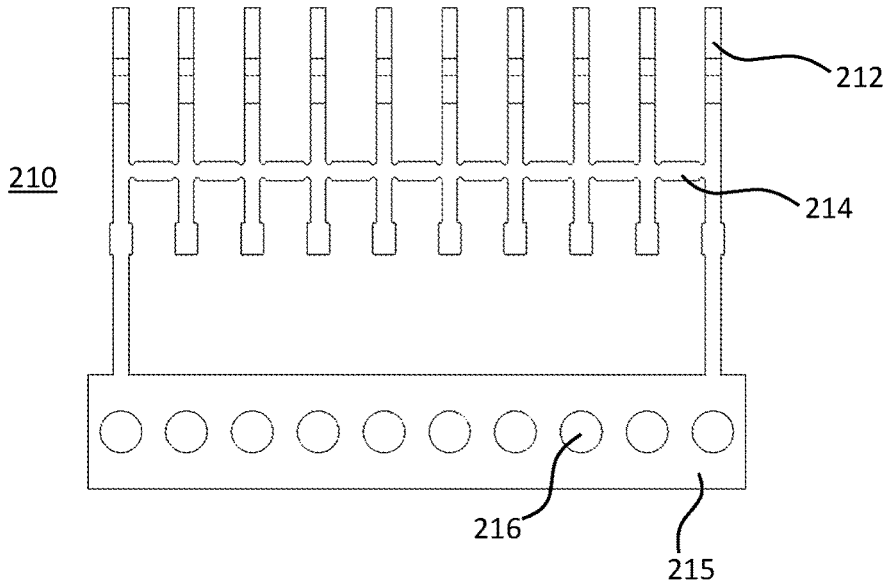
FIGS. 29A to 33 show a process of providing a high-speed cable assembly according to the third preferred embodiment of the present invention.
Figure 29B:
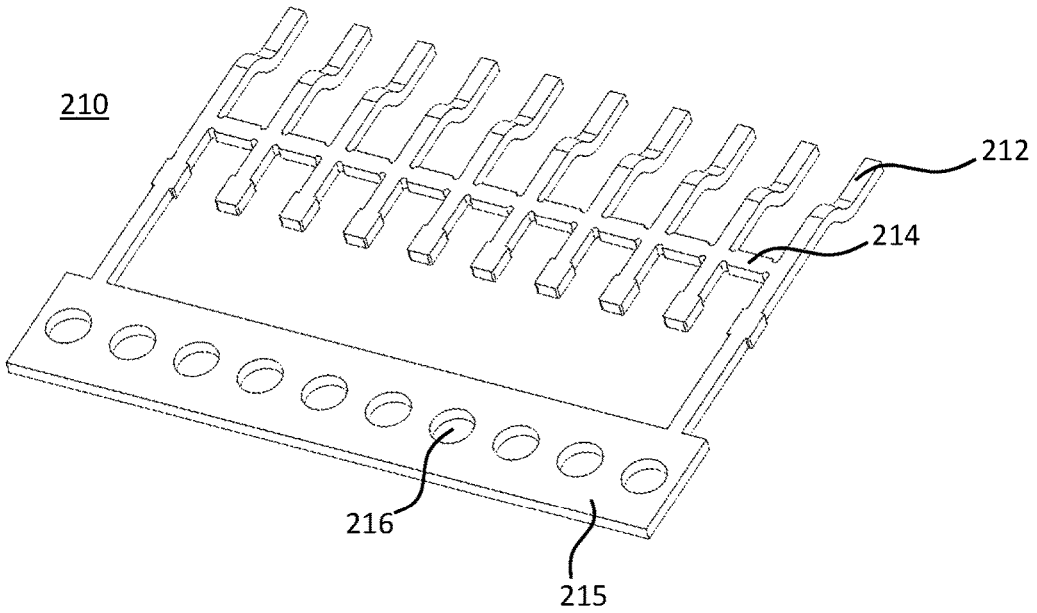

FIGS. 29A to 33 show a process of providing a high-speed cable assembly according to the third preferred embodiment of the present invention. As shown in FIGS. 29A and 29B, the contacts 212 that are to transmit signals are cut or stamped so that they are no longer connected to the ground plane 215. The number of contacts 212 that are cut preferably corresponds to the number of contacts in the high-speed cable assembly. Preferably, not all of the contacts 212 are cut such that the rigid structure is maintained for the contact ribbon 210 during assembly and further manufacturing of the high-speed cable assembly. For example, as shown in FIGS. 29A and 29B, the outermost ones of the contacts 212 are preferably left connected to the ground plane 215 to provide ground connections and to provide structural support during manufacturing and assembling of the high-speed cable assembly.

Figure 30A:
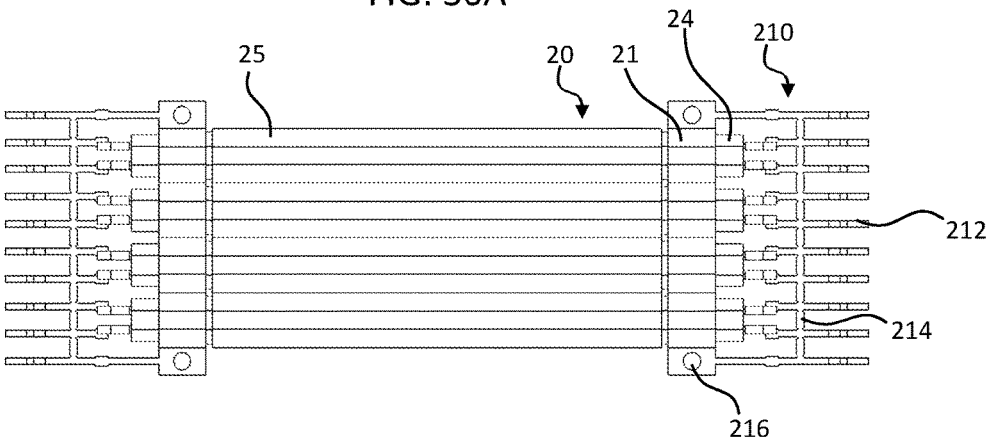
Figure 30B:
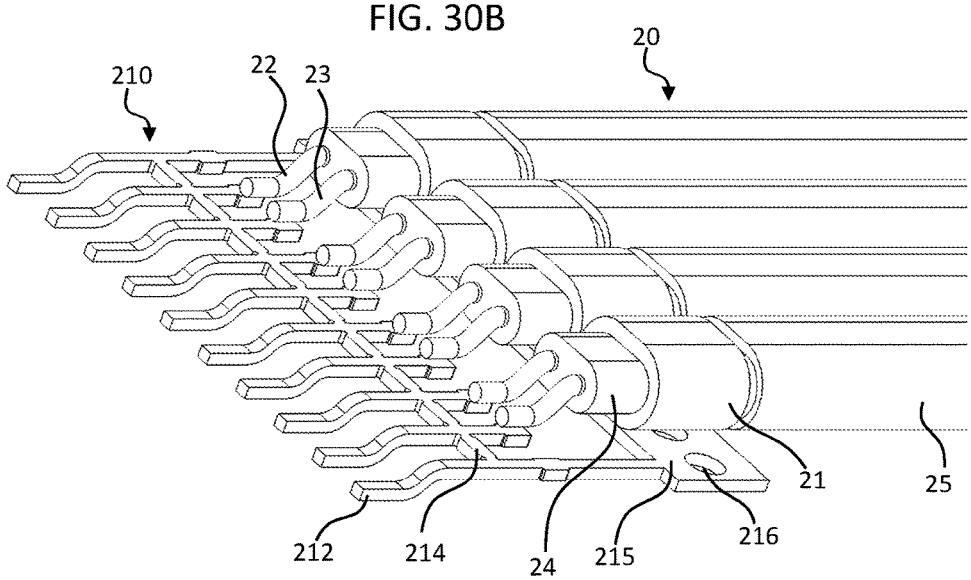

Next, as shown in FIG. 30A, a contact ribbon 210 is connected at both ends of a ribbonized twinaxial cable 20. FIG. 30B is a perspective view of the connections between the contact ribbon 210 and the ribbonized twinaxial cable 20. Preferably, the contact ribbon 210 is connected to the ribbonized twinaxial cable 20 in the same manner as the contact ribbon 10 of the first preferred embodiment of the present invention. That is, as shown in FIG. 30B, the first and second center conductors 22 and 23 of the ribbonized twinaxial connector 20 are connected to alternating ones of the contacts 212 of the contact ribbon 210, and the shield 21 of the ribbonized twinaxial connector 20 is connected with the ground plane 215. The connections between the contacts 212 and the first and second center conductors 22 and 23 and between the shield 21 and the ground plane 215 can occur either simultaneously or successively.

Figure 31:
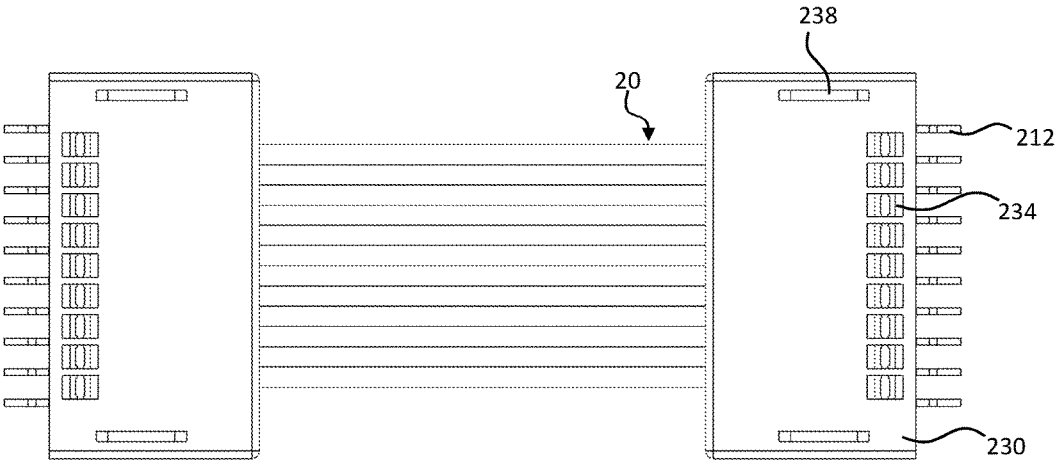
Figure 32:
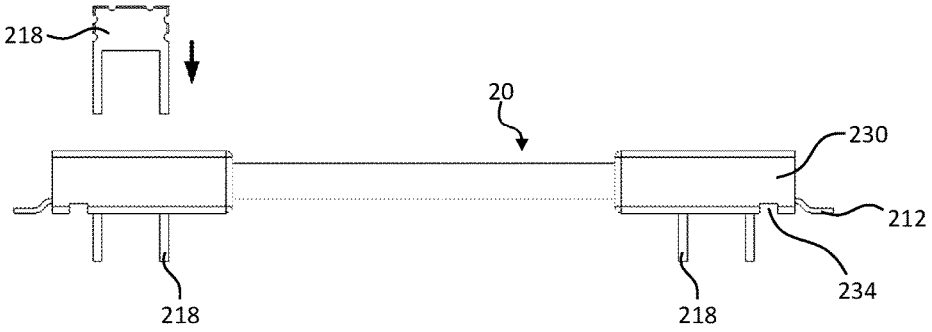
Figure 33:
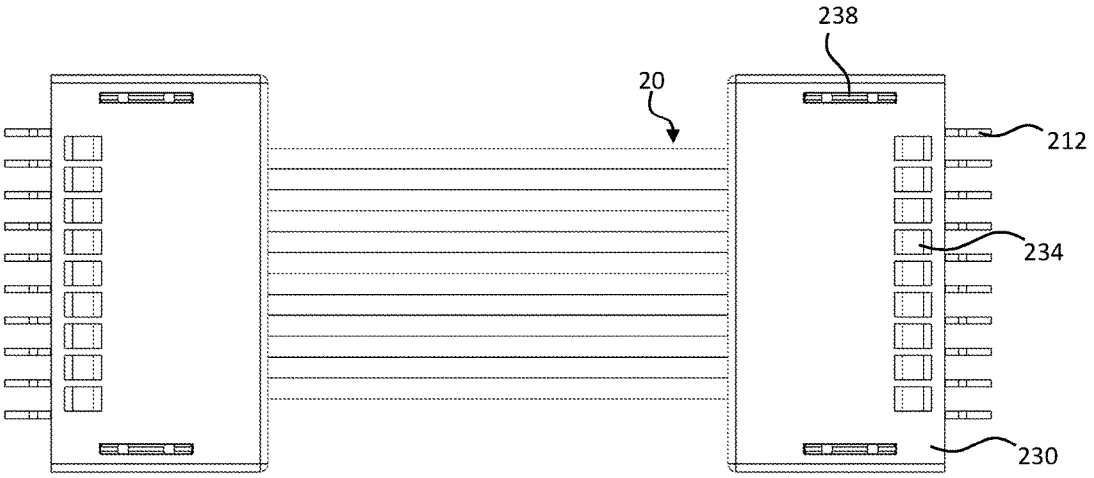

FIG. 31 shows a step of overmolding a connector housing 230 on the contact ribbon 210 to form an electrical connector of the high-speed cable assembly. The connector housing 230 is formed with holes 234 that are arranged over the tie bars 214 of the contact ribbon 210 when the connector housing 230 is molded over the contact ribbon 210. Weld tabs 218 are then inserted into weld tab holes 238 of the connector housing 230, as shown in FIG. 32, such that the legs of the weld tabs 218 extend from the body of the connector housing 230. As shown in FIG. 33, after overmolding the connector housing 230 on the contact ribbon 210, the tie bars 214 are removed, preferably by a tool punching into the holes 234 of the connector housing 230. Accordingly, the contacts 212 are structurally and electrically disconnected from each other and from the ground plane 15. Further, any portions of the contact ribbon 210 that laterally overhang from the connector housing 230 (not shown) may be removed, preferably by cutting or stamping.

Instead of using overmolding for the connector housing 230, any housing can be used that allows the tie bars 214 between the contacts 212, 213 to be removed. Such housings include, for example, snap-on, sonically welded, screwed-on, and glued housings. However, overmolding is preferred for the connector housing 230 because of its simplicity and because it is easier for a tool to remove the tie bars 214.

Figure 34A:
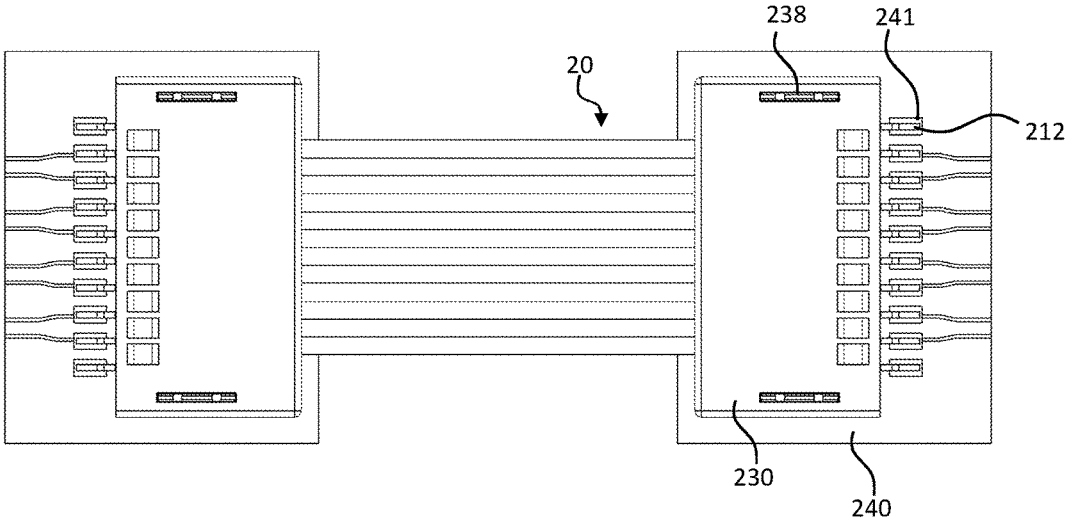
FIGS. 34A and 34B show the high-speed cable assembly shown in FIG. 33 connected to a substrate.
Figure 34B:
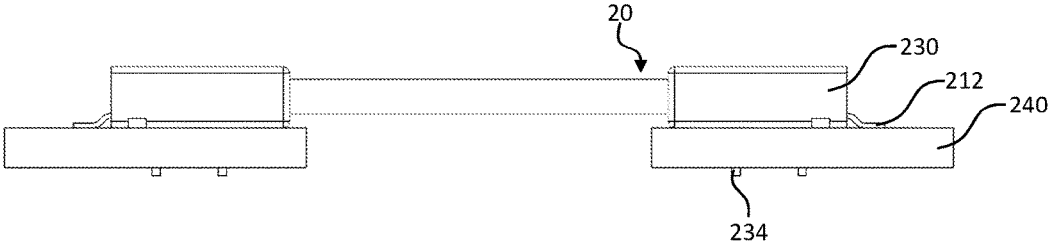
Figure 34C:
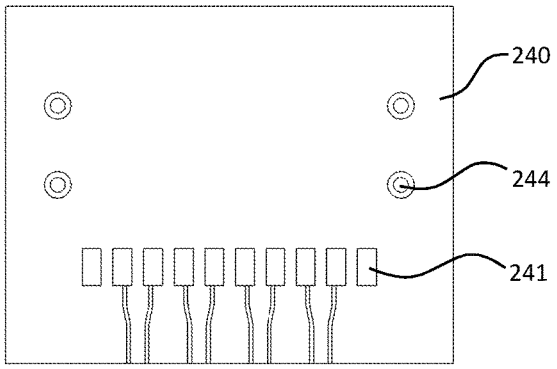
FIG. 34C is a plan view of the substrate shown in FIGS. 34A and 34B.

FIGS. 34A and 34B show the high-speed cable assembly shown in FIG. 33 connected to substrates 240. FIG. 34C is a plan view of one of the substrates 240 shown in FIGS. 34A and 34B. Preferably, the high-speed cable assembly is initially connected by inserting the legs of the weld tabs 218 into the mounting holes 244 of the substrates 240. Preferably, the mounting holes 244 of the substrates 240 are lined with solder so that the weld tabs 218 can be easily secured to the mounting holes 244 to fasten the high-speed cable assembly to the substrates 240. Alternatively or in addition, the legs of the weld tabs 218 may include an "eye-of-the-needle" configuration to be press-fit to the mounting holes 244.

As shown in FIGS. 34A and 34C, the substrates 240 include pads 241 that respectively align with the contacts 212 of the high-speed cable assembly. Preferably, the contacts 212 are secured to the pads 241 by a solder connection, although other connection types may be used, such as those described above with respect to the first and second preferred embodiments of the present invention. Preferably, the interior ones of the pads 241 are connected to signal traces on the substrates 240, and the outermost ones of the pads 241 provide ground connections. However, other arrangements can be used, for example, every third one of the contacts 212 may provide a ground connection.

The high-speed cable assembly according to the third preferred embodiment of the present invention can be connected to the same substrate or to different substrates, including the various specific applications shown in FIGS. 8A to 13B and FIGS. 22A to 27B of the first and second preferred embodiments of the present invention.

Figure 35:
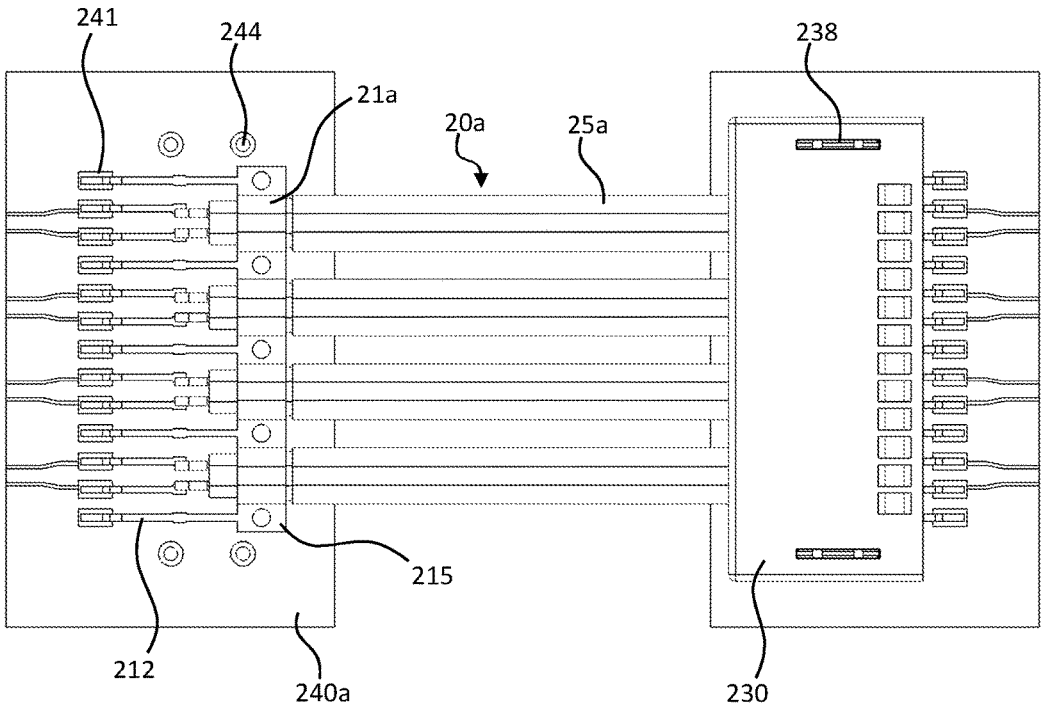
FIG. 35 shows a cable assembly with surface-mount contacts and separate twinaxial cables according to the third preferred embodiment of the present invention.

FIG. 35 shows a modification of the third preferred embodiment of the present invention, which includes a high-speed cable assembly with surface-mount contacts and separate twinaxial cables. As shown in FIG. 35, in place of the ribbonized twinaxial cable 20, separate twinaxial cables 20*a* may be used with the third preferred embodiment of the present invention. The separate twinaxial cables 20*a* each include a respective jacket 25*a* and a respective shield 21*a* that is connected to the ground plane 215. Preferably, each of the separate twinaxial cables 20*a* are spaced apart from each other, such that a contact 212 connected to ground is included between each pair of contacts 212 associated with one of the separate twinaxial cables 20*a*. Accordingly, as shown in FIG. 35, the substrates 240*a* are preferably modified so that signal traces are not included for these additional ground connections. Furthermore, other types of cables, such as coaxial cables, can be used in place of the separate twinaxial cables 20*a*.

Although the high-speed cable assembly according to the preferred embodiments of the present invention preferably includes the ribbonized twinaxial cable 20, the present invention is not limited thereto. For example, the high-speed cable assembly may include one or more separate twinaxial cables that each include a single pair of center conductors (for example, the twinaxial cable 20*a* shown in FIG. 35), a ribbonized coaxial cable, or one or more coaxial cables that each include only a single center conductor. Furthermore, other types of cables may be used.

In addition to reducing cross-talk between center conductors, a contact connected to ground may be included between each pair of center conductors of twinaxial cables or ribbonized twinaxial cables, for example, as shown in FIG. 35. Similarly, a contact connected to ground may be included between each center conductor of coaxial cables or ribbonized coaxial cables.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A cable assembly comprising:

a single stamped sheet of metal including:

a plurality of pairs of first and second signal contacts;

a ground plane; and a plurality of ground contacts connected to the ground plane along a side of the ground plane such that a line extending through the plurality of ground contacts does not intersect with any signal contacts of the plurality of pairs of first and second signal contacts;

a twinaxial cable including a plurality of pairs of first and second center conductors, each pair of the plurality of pairs of first and second center conductors is connected to a corresponding pair of the plurality of pairs of first and second signal contacts; wherein the plurality of pairs of first and second signal contacts are solderable contacts such that, when the cable assembly is connected to a substrate, the plurality of pairs of first and second signal contacts are soldered to the substrate.

2. The cable assembly according to claim 1, wherein:

the plurality of pairs of first and second signal contacts are initially connected to both the ground plane and a support member connecting the plurality of pairs of first and second signal contacts; and the plurality of pairs of first and second signal contacts are disconnected from the ground plane before the signal contacts are connected to the twinaxial cable.

3. The cable assembly according to claim 1, wherein:

the single stamped sheet of metal is included in a housing; and a support member connecting the plurality of pairs of first and second signal contacts is removed from the single stamped sheet of metal after the single stamped sheet of metal is included in the housing.

4. The cable assembly according to claim 1, wherein a support member connecting the plurality of pairs of first and second signal contacts is removed after the cable assembly is connected to the substrate.

5. The cable assembly according to claim 1, wherein:

the plurality of pairs of first and second signal contacts are arranged in at least a first row and a second row; and the first row and the second row are offset from each other.

6. The cable assembly according to claim 1, wherein the twinaxial cable includes:

a plurality of insulators each surrounding a corresponding pair of the plurality of pairs of first and second center conductors; and a shield that surrounds the plurality of insulators and that is connected to the ground plane.

7. A method of manufacturing a cable assembly, comprising:

providing a single stamping with a plurality of pairs of first and second signal contacts and a ground plane with a plurality of ground contacts connected to the ground plane along a side of the ground plane such that a line extending through the plurality of ground contacts does not intersect with any signal contacts of the plurality of pairs of first and second signal contacts;

providing a twinaxial cable with a plurality of pairs of first and second center conductors;

connecting each pair of the plurality of pairs of first and second signal contacts to a corresponding pair of the plurality of pairs of first and second center conductors at a first end of the twinaxial cable; and connecting the twinaxial cable to the ground plane at the first end of the twinaxial cable; wherein the plurality of pairs of first and second signal contacts are solderable contacts such that, when the cable assembly is connected to a substrate, the plurality of pairs of first and second signal contacts are soldered to the substrate.

8. The method of manufacturing a cable assembly according to claim 7, wherein each pair of the plurality of pairs of first and second signal contacts is connected to the corresponding pair of the plurality of pairs of first and second center conductors by crimping or soldering.

9. The method of manufacturing a cable assembly according to claim 7, wherein a shield is connected to the ground plane by soldering.

10. The method of manufacturing a cable assembly according to claim 7, further comprising forming a housing for the single stamping before a support member connecting the plurality of pairs of first and second signal contacts is removed.

11. The method of manufacturing a cable assembly according to claim 10, wherein:

the housing includes at least one hole; and the support member is removed by punching or cutting the support member through the at least one hole of the housing.

12. The method of manufacturing a cable assembly according to claim 7, further comprising attaching the cable assembly to the substrate before a support member connecting the plurality of pairs of first and second signal contacts is removed.

13. The method of manufacturing a cable assembly according to claim 12, wherein each signal contact of the plurality of pairs of first and second signal contacts is connected to a corresponding hole in the substrate by soldering.

14. The method of manufacturing a cable assembly according to claim 7, further comprising:

forming a housing for the single stamping before a support member connecting the plurality of pairs of first and second signal contacts is removed, the housing including at least one hole; and inserting a weld tab into the at least one hole of the housing.

15. The method of manufacturing a cable assembly according to claim 14, further comprising attaching the cable assembly to the substrate by inserting a leg of the weld tab into a corresponding hole in the substrate.

16. The method of manufacturing a cable assembly according to claim 15, wherein the support member is a carrier attached to the plurality of pairs of first and second signal contacts.

17. The method of manufacturing a cable assembly according to claim 7, wherein a tie bar is connected between adjacent signal contacts in the plurality of pairs of first and second signal contacts.

18. The method of manufacturing a cable assembly according to claim 7, further comprising providing a second single stamping connected to a second end of the cable.

19. The method of manufacturing a cable assembly according to claim 18, wherein:

the plurality of pairs of first and second signal contacts of the single stamping are arranged in at least a first row and a second row;

the first row and the second row are offset from each other; and a plurality of pairs of first and second signal contacts of the second single stamping are respectively arranged in rows corresponding to the first row and the second row in an opposing manner such that an overall signal transmission length for each of the conductors of the twinaxial cable is the same or substantially the same.

20. A cable assembly comprising:

a single stamped sheet of metal including:

a plurality of pairs of first and second signal contacts;

a ground plane; and a plurality of ground contacts connected to the ground plane along a side of the ground plane such that a line extending through the plurality of ground contacts does not intersect with any signal contacts of the plurality of pairs of first and second signal contacts; and a twinaxial cable including a plurality of pairs of first and second center conductors, each pair of the plurality of pairs of first and second center conductors is connected to a corresponding pair of the plurality of pairs of first and second signal contacts; wherein the plurality of pairs of first and second pairs of first and second signal contacts are press-fit contacts such that, when the cable assembly is connected to a substrate, the plurality of pairs of first and second signal contacts are press fit into corresponding holes in the substrate.

21. A method of manufacturing a cable assembly, comprising:

providing a single stamping with a plurality of pairs of first and second signal contacts and a ground plane with a plurality of ground contacts connected to the ground plane along a side of the ground plane such that a line extending through the plurality of ground contacts does not intersect with any signal contacts of the plurality of pairs of first and second signal contacts;

providing a twinaxial cable with a plurality of pairs of first and second center conductors;

connecting each pair of the plurality of pairs of first and second signal contacts to a corresponding pair of first and second center conductors at a first end of the twinaxial cable; and connecting the twinaxial cable to the ground plane at the first end of the twinaxial cable; wherein the plurality of pairs of first and second signal contacts are press-fit contacts such that, when the cable assembly is connected to a substrate, the plurality of pairs of first and second signal contacts are press fit into corresponding holes in the substrate.

* * * * *